US009199450B2

(12) United States Patent
Otokita

(10) Patent No.: US 9,199,450 B2
(45) Date of Patent: Dec. 1, 2015

(54) LIQUID DISCHARGE APPARATUS AND RESIDUAL VIBRATION DETECTION METHOD

(71) Applicant: SEIKO EPSON CORPORATION, Tokyo (JP)

(72) Inventor: Kenji Otokita, Yamagata-mura (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/618,078

(22) Filed: Feb. 10, 2015

(65) Prior Publication Data

US 2015/0239239 A1 Aug. 27, 2015

(30) Foreign Application Priority Data

Feb. 27, 2014 (JP) ..... 2014-036405

(51) Int. Cl.
*B41J 2/045* (2006.01)

(52) U.S. Cl.
CPC ..... *B41J 2/04541* (2013.01); *B41J 2/0451* (2013.01)

(58) Field of Classification Search
CPC ..... B41J 2/14201; B41J 2/0451
See application file for complete search history.

(56) References Cited

U.S. PATENT DOCUMENTS

| | | | | |
|---|---|---|---|---|
| 6,984,010 | B2 * | 1/2006 | Hosono et al. | 347/19 |
| 7,300,131 | B2 | 11/2007 | Sakagami et al. | |
| 2004/0223027 | A1 | 11/2004 | Shinkawa et al. | |
| 2012/0274689 | A1 * | 11/2012 | Zhang | 347/10 |

FOREIGN PATENT DOCUMENTS

| | | | |
|---|---|---|---|
| JP | 2004-276544 | A | 10/2004 |
| JP | 2007-030343 | A | 2/2007 |
| JP | 3933186 | B2 | 6/2007 |
| JP | 2012-045957 | A | 3/2012 |

* cited by examiner

*Primary Examiner* — Geoffrey Mruk
(74) *Attorney, Agent, or Firm* — Global IP Counselors, LLP

(57) ABSTRACT

A liquid discharge apparatus includes: a head having a piezoelectric element that vibrates a diaphragm, a pressure chamber where an interior pressure is increased or decreased by vibration of the diaphragm, and a nozzle communicating with the pressure chamber to discharge a liquid inside the pressure chamber according to increasing and decreasing of the interior pressure; a drive unit that outputs a drive signal which becomes a first potential during a first period, becomes a second potential during a second period following the first period, and becomes a third potential, which is a potential between the first potential and the second potential, during a third period following the second period; a detection unit that detects a residual vibration inside the pressure chamber; and a control unit capable of modifying the potential of the third potential within a range between the first potential and the second potential.

5 Claims, 24 Drawing Sheets

| SI (b1,b2,b3) | Tc1 | | | Tc2 | | |
|---|---|---|---|---|---|---|
| | Sa | Sb | Sc | Sa | Sb | Sc |
| (1,1,0) | H | L | L | H | L | L |
| (1,0,0) | H | L | L | L | H | L |
| (0,1,0) | L | H | L | H | L | L |
| (0,0,0) | L | H | L | L | H | L |
| (0or1,0or1,1) | L | L | H | L | L | H |

Fig. 16

| FLAG | NTc (COMPARISON CONTENT) | Rs |
|---|---|---|
| 1 | NTc < NTx1 | 2: DISCHARGE MALFUNCTION (AIR BUBBLING) |
| | NTx1 ≤ NTc ≤ NTx2 | 1: NORMAL |
| | NTx2 < NTc ≤ NTx3 | 3: DISCHARGE MALFUNCTION (PAPER DUST) |
| | NTx3 < NTc | 4: DISCHARGE MALFUNCTION (THICKENING) |
| 0 | N/A | 5: DISCHARGE MALFUNCTION |

Fig. 25

LIQUID DISCHARGE APPARATUS AND RESIDUAL VIBRATION DETECTION METHOD

CROSS-REFERENCE TO RELATED APPLICATIONS

This application claims priority to Japanese Patent Application No. 2014-036405 filed on Feb. 27, 2014. The entire disclosure of Japanese Patent Application No. 2014-036405 is hereby incorporated herein by reference.

BACKGROUND

1. Technical Field

The present invention relates to a liquid discharge apparatus and a residual vibration detection method.

2. Related Art

An inkjet printer, serving as a liquid discharge apparatus, that discharges a liquid (ink) in the form of liquid droplets from a head using an inkjet format (an inkjet head) and forms an image on a medium such as paper has conventionally been widely utilized, owing to the ease with which relative low-cost and high-quality printed products are obtained. The head of the inkjet printer has a piezoelectric element for causing a diaphragm to vibrate, a pressure chamber in which a liquid is held in the interior and the internal pressure is increased and decreased by the vibration of the diaphragm, and a plurality of nozzles provided to a nozzle surface of the head so as to communicate with the pressure chamber; a drive signal drives the piezoelectric element, causing the pressure of the pressure chamber to increase and decrease and thereby causing the liquid to be discharged from the nozzles.

Due in to an increase in the viscosity of the ink, admixture of air bubbles, adhesion of dust or paper particles, or the like, the head of the inkjet printer may in some instances experience a discharge malfunction, during which ink droplets are not discharged normally from some nozzles of the plurality of nozzles. When such a discharge malfunction takes place, dot loss occurs in the image that is printed, and this causes the image quality to be degraded; therefore, it is desirable to inspect the state of discharge.

In one example of a method of inspecting the state of discharge of a liquid, Japanese laid-open patent publication No. 2004-276544 discloses a method for outputting a drive signal to a piezoelectric element, detecting a residual vibration that follows the pressure change inside the pressure chamber caused by the drive signal, as a change in the electromotive force of the piezoelectric element, and determining the state of discharge of the ink from the nozzles based on the vibration pattern of the residual vibration.

SUMMARY

However, should any ink be discharged by the vibration imparted to the piezoelectric element in a case where the state of discharge of the ink is inspected during printing by the inkjet printer, then the recording medium ends up being fouled, and moreover ink ends up being consumed. For this reason, during inspection of the state of discharge there has been a desire to ensure that ink is not discharged by, for example, applying a small-amplitude inspection pulse to the piezoelectric element to drive the piezoelectric element. The small-amplitude inspection pulse has not allowed for accurate detection of the residual vibration, however, because little excitation force is applied to the ink.

That is to say, in the head, a problem has emerged in that it is not possible to generate the large residual vibration that is needed for detection, without also causing the liquid to be discharged.

The present invention has been made in order to solve the above-mentioned problem, at least in part, and can be realized as the following modes or application examples.

A liquid discharge apparatus includes a head, a drive unit, a detection unit and a control unit. The head has a piezoelectric element configured and arranged to vibrate a diaphragm, a pressure chamber where an interior pressure is increased or decreased by vibration of the diaphragm, and a nozzle communicating with the pressure chamber and configured and arranged to discharge a liquid inside the pressure chamber according to increasing and decreasing of the interior pressure of the pressure chamber. The drive unit is configured and arranged to output a drive signal to the piezoelectric element such that the drive signal becomes a first potential during a first period, becomes a second potential during a second period following the first period, and becomes a third potential, which is a potential between the first potential and the second potential, during a third period following the second period. The detection unit is configured and arranged to detect a residual vibration inside the pressure chamber that is produced by the drive signal. The control unit is configured to modify the potential of the third potential of the drive signal within a range between the first potential and the second potential.

According to this aspect, it is possible to generate a residual vibration of the magnitude needed for detection, without causing liquid to be discharged, by applying a major excitation force to the liquid in the process of the transition from the first potential to the second potential and thereafter changing from the second potential to the third potential and retaining the third potential. Also, because the third potential can be modified, the potential of the third potential can be made to be a potential that corresponds to the state of the liquid.

In the liquid discharge apparatus as in the above aspect, the control unit is preferably configured to modify the potential of the third potential of the drive single based on a change in inertance of the nozzle.

According to this aspect, the potential of the third potential can be made to be a potential that corresponds to the inertance, which changes depending on the state of the liquid.

In the liquid discharge apparatus as in the above aspect, the control unit is preferably configured to modify the potential of the third potential of the drive signal based on a vibration frequency of the pressure chamber, which changes in association with the change in inertance.

According to this aspect, the potential of the third potential can be made to be a potential that corresponds to the vibration frequency of the pressure chamber, which changes depending on the inertance.

In the liquid discharge apparatus as in the above aspect, the control unit is preferably configured to modify the potential of the third potential of the drive signal based on a difference between: a vibration frequency of the pressure chamber at a discharge potential, which is a potential at which the liquid is discharged from the nozzle; and a vibration frequency of the pressure chamber at a non-discharge potential, which is a potential at which the liquid is not discharged from the nozzle.

According to this aspect, the third potential can be made to be the non-discharge potential at higher accuracy, and a residual vibration of the magnitude needed for detection can be generated without causing the liquid to be discharged.

In the liquid discharge apparatus as in the above aspect, the detection unit is preferably configured and arranged to detect the residual vibration when the drive signal is in the third period.

According to this aspect, a residual vibration of the magnitude needed for detection, having been generated without causing the liquid to be discharged, can be detected with higher accuracy.

A method according to another aspect is a method of detecting residual vibration in a head having a piezoelectric element configured and arranged to vibrate a diaphragm, a pressure chamber where an interior pressure is increased or decreased by vibration of the diaphragm, and a nozzle communicating with the pressure chamber and configured and arranged to discharge a liquid inside the pressure chamber according to increasing and decreasing of the interior pressure of the pressure chamber. The method includes: outputting a drive signal to the piezoelectric element such that the drive signal becomes a first potential during a first period, becomes a second potential during a second period following the first period, and becomes a third potential, which is a potential between the first potential and the second potential, during a third period following the second period; detecting a residual vibration in the pressure chamber that is produced by the drive signal; and modifying the potential of the third potential of the drive signal in a range between the first potential and the second potential.

According to this aspect, it is possible to generate a residual vibration of the magnitude needed for detection, without causing liquid to be discharged, by applying a major excitation force to the liquid in the process of the transition from the first potential to the second potential and thereafter changing from the second potential to the third potential and retaining the third potential. Also, because the third potential can be modified, the potential of the third potential can be made to be a potential that corresponds to the state of the liquid.

BRIEF DESCRIPTION OF THE DRAWINGS

Referring now to the attached drawings which form a part of this original disclosure:

FIG. 16 is a descriptive view illustrating decoding content of a decoder;

FIG. 25 is a descriptive view for describing the generation of a determination result signal in a determination unit.

DETAILED DESCRIPTION OF EXEMPLARY EMBODIMENTS

Modes for carrying out the present invention shall be described below with reference to the accompanying drawings. In each of the drawings, the dimensions and scale of each of the parts have been altered from the actual ones where appropriate. Also, the embodiment described below is a preferred specific example of the present invention, and therefore a variety of technically preferable limitations have been imposed, but the scope of the present invention is in no way intended to be limited to these modes except where the description below refers in particular to limiting the present invention.

A. Embodiment

The present embodiment describes by way of example a line printer of the inkjet type, where ink (one example of a "liquid") is discharged and an image is formed on recording paper P (one example of a "recording medium"), as a printing apparatus.

Figure 1:
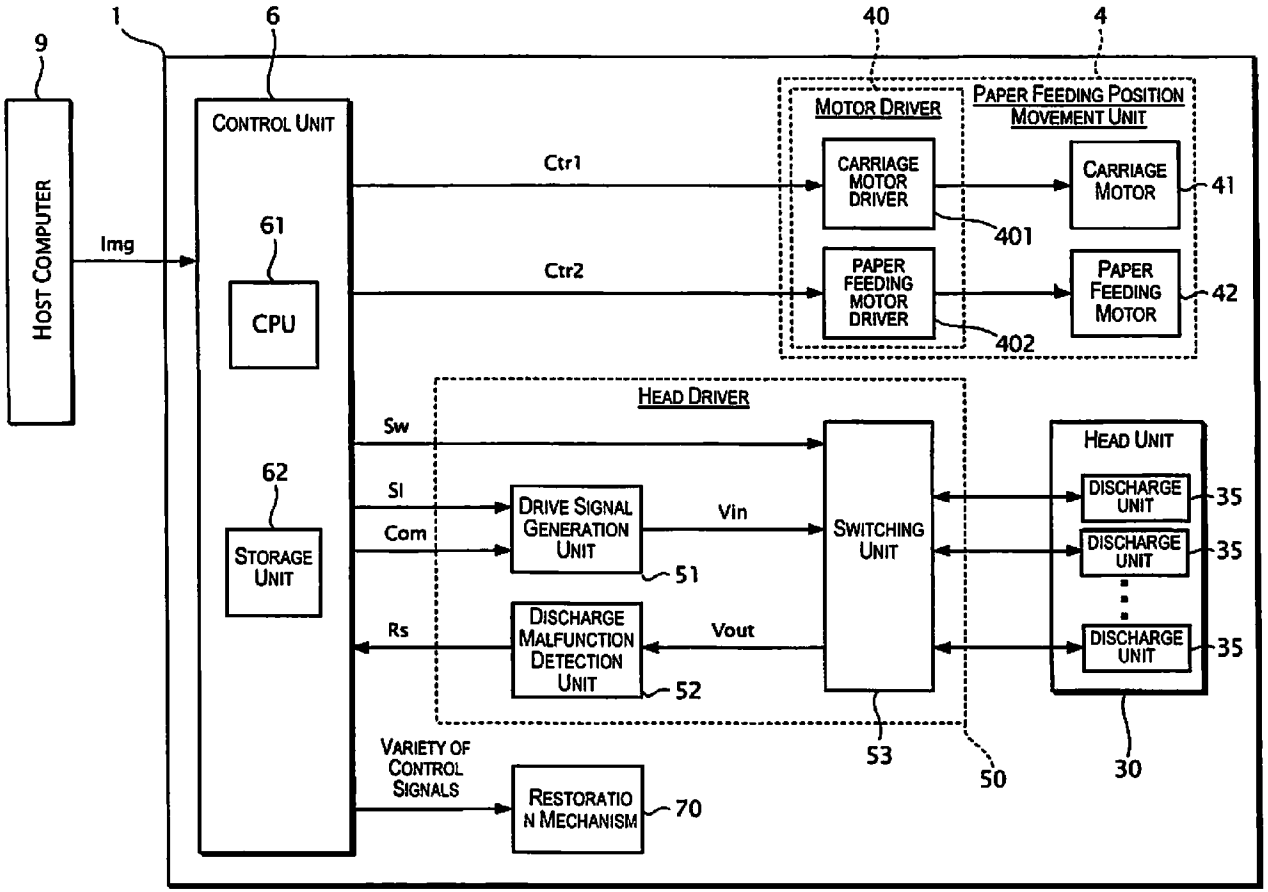
FIG. 1 is a block diagram illustrating the configuration of an inkjet printer serving as a liquid discharge apparatus as in an embodiment of the present invention.

FIG. 1 is a functional block diagram illustrating the configuration of an inkjet printer 1 as in the present embodiment. As illustrated in FIG. 1, the inkjet printer 1 is provided with: a head unit 30 equipped with a number M (where M is a natural number 2 or higher) of discharge units 35 capable of discharging an ink held in the interior; a head driver 50 for driving the head unit 30; a paper feeding position movement unit 4 (one example of a "relative position movement unit") for moving the relative position of the head unit 30 with respect to the recording paper P; and a restoration mechanism 70 for executing a restoration process for restoring the normal state of discharge of a relevant discharge unit 35 in a case where a discharge malfunction has been detected in the discharge units 35. Below, the "head unit 30" is also simply called a "head".

The inkjet printer 1 is also provided with a control unit 6 for controlling the execution of a variety of processes, such as a printing process for forming an image on the recording paper P by controlling the operation of the paper feeding position movement unit 4, the head driver 50, and the restoration mechanism 70 based on image data Img supplied from a host computer 9 such as a personal computer or digital camera, a discharge malfunction detection process for detecting a discharge malfunction of the discharge units 35, and a restoration process for restoring the normal state of discharge of the discharge units 35.

The control unit 6 is provided with a CPU 61 and a storage unit 62.

The storage unit 62 is provided with an electrically erasable programmable read-only memory (EEPROM), which is a type of non-volatile semiconductor memory having a data storage area that stores the image data Img, which is supplied from the host computer 9 via an interface unit (not shown). The storage unit 62 is also provided with a random access memory for temporarily storing data necessary when the printing process is being executed such as information about the shape of the recording paper P, and discharge malfunction detection result data representing a result obtained by the discharge malfunction detection process, or for temporarily storing a control program for executing a variety of processes such as the printing process. The storage unit 62 is also provided with a PROM, which is one type of non-volatile semiconductor memory for storing, inter alia, a control program for controlling each of the parts of the inkjet printer 1.

The CPU 61 controls the execution of a variety of processes such as the printing process, the discharge malfunction detection process, and the restoration process. More specifically, the CPU 61 stores the image data Img supplied from the host computer 9 in the storage unit 62. In part based on a variety of data stored in the storage unit 62, such as the image data Img, the CPU 61 generates: driver control signals Ctr1 and Ctr2 for controlling the driving of the paper feeding position movement unit 4; a variety of signals, such as a print signal SI, a switching control signal Sw, and a drive waveform signal Com, for controlling the driving of the head driver 50; and a variety of control signals for controlling the driving of the restoration mechanism 70; these signals are supplied to the respective parts of the inkjet printer 1. The CPU 61 thereby controls the operation of the paper feeding position movement unit 4, the head driver 50, and the restoration mechanism 70, and controls the execution of a variety of processes such as the printing process, the discharge malfunction detection process, and the restoration process. Each of the constituent elements of the control unit 6 is electrically connected via a bus (not shown).

The head driver is provided with a drive signal generation unit 51, a discharge malfunction detection unit, and a switching unit 53.

The drive signal generation unit 51 generates a drive signal Vin for driving the discharge units 35 provided to the head unit 30, based on the print signal SI and drive waveform signal Com supplied from the control unit 6. A more detailed description shall follow, but in the present embodiment, the drive waveform signal Com comprises three signals: drive waveform signals Com-A, Com-B, and Com-C.

The print signal SI and drive waveform signal Com are also collectively called a "printing control signal". In other words, the drive signal generation unit 51 generates the drive signal Vin based on the printing control signal.

The discharge malfunction detection unit 52: detects, as a residual vibration signal Vout, a change in pressure in a discharge unit 35 interior that is caused, inter alia, by a vibration of the ink of the interior of the discharge unit 35 arising after the discharge unit 35 has been driven by the drive signal Vin; determines whether or not that discharge unit 35 has a discharge malfunction and also determines the state of discharge of the ink in that discharge unit 35, based on the residual vibration signal Vout; and outputs a determination result as a determination result signal Rs.

The switching unit 53 connects each of the discharge units 35 to either the drive signal generation unit 51 or the discharge malfunction detection unit 52, based on the switching control signal Sw supplied from the control unit 6.

The paper feeding position movement unit 4 is provided with a carriage motor 41 for causing the head unit 30 to move (or, more precisely, for causing a carriage 32, on which the head unit 30 is mounted, to move), a carriage motor driver 401 for driving the carriage motor 41, a paper feeding motor 42 for conveying the recording paper P, and a paper feeding motor driver 402 for driving the paper feeding motor 42. The carriage motor driver 401 and the paper feeding motor driver 402 are in some instances collectively called a motor driver.

Figure 2:
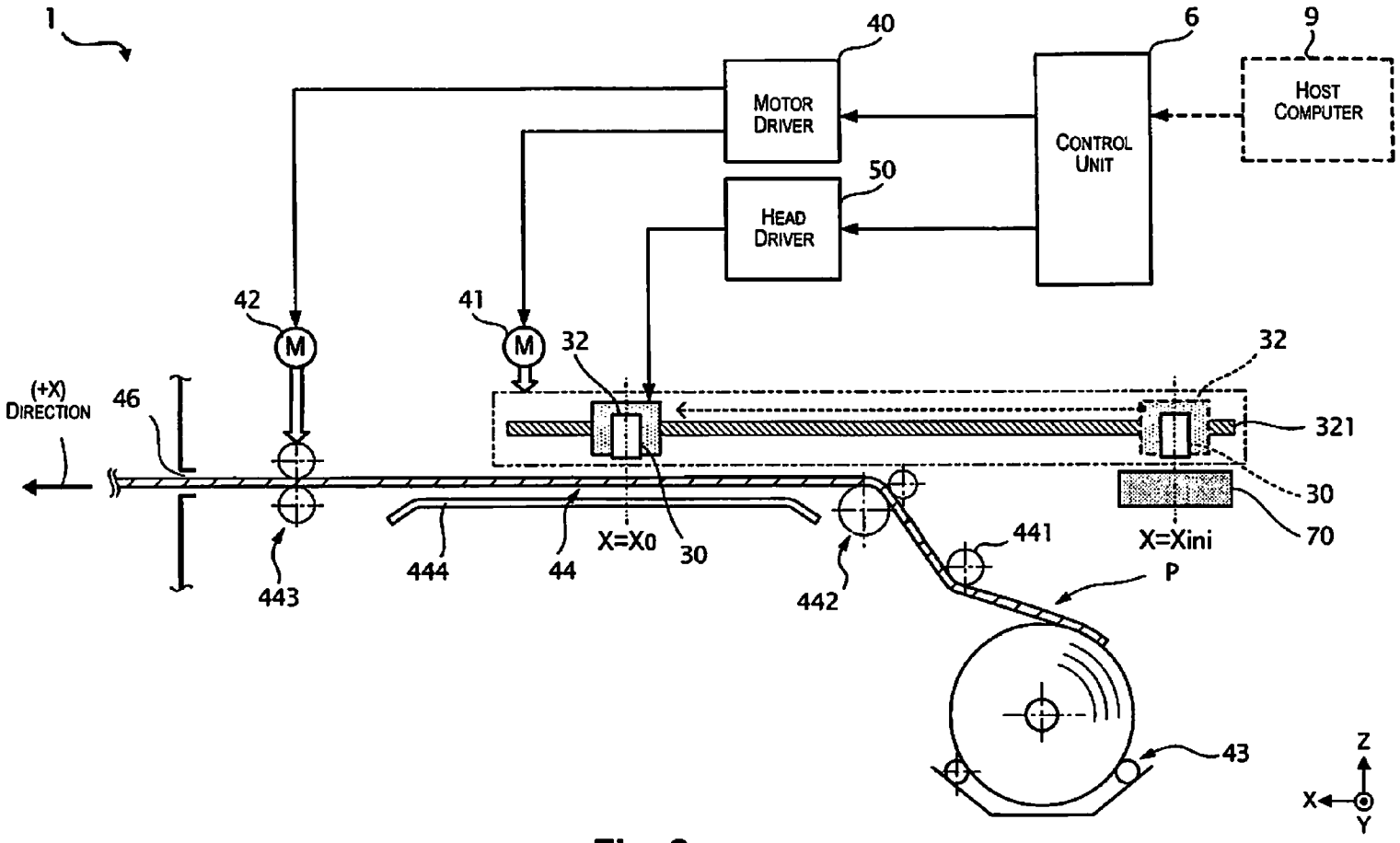
FIG. 2 is a descriptive view illustrating a schematic configuration of an inkjet printer.

FIG. 2 is a schematic diagram illustrating the configuration of the inkjet printer 1. As illustrated in FIG. 2, the inkjet printer 1 is provided with a roll paper storage unit 43 for storing a roll paper of a configuration by which the recording paper P is wound in the form of a roll; the recording paper P is fed out from being stored in this roll paper storage unit 43. A drive-side paper feeding roller pair 443 that is rotatingly driven by the paper feeding motor 42 conveys the recording paper P in an X-axis direction along a conveyance route 44 regulated in part by a guide roller 441, a driven-side paper feeding roller pair 442, the drive-side paper feeding roller pair 443, and a platen 444; the recording paper P is then carried out from a paper discharge port 46.

The carriage 32 on which the head unit 30 is mounted is arranged on the opposite side of the platen 444 across the conveyance route 44 of the recording paper P, i.e., in the (+Z) direction as seen from the platen 444. The carriage 32 can be moved in rectilinear reciprocation through a predetermined range along the X-axis direction by a head unit movement mechanism comprising: a carriage guide shaft 321, which is composed of, for example, a ball screw, ball spline, or the like extending in the X-axis direction; and the carriage motor 41.

The control unit 6 executes the printing process by moving the head unit 30 to a printing position (X=X0) and, in this state, causing the ink to be discharged based on the image data Img in a region where a label Lb of the recording paper P is arranged from the plurality of discharge units 35 provided to the head unit 30, at the same time, while the recording paper P is being conveyed in the X-axis direction.

In a case where a discharge malfunction of the discharge units 35 has been discovered, then the control unit 6 moves the head unit 30 to an initial position (X=Xini) facing the restoration mechanism 70 and executes the restoration process.

Though omitted in FIG. 2, the inkjet printer 1 is provided with four ink cartridges containing ink. More specifically, the four ink cartridges are provided in one-to-one corresponding with the four colors yellow, cyan, magenta, and black, and are mounted onto the carriage 32.

Each of the number M of discharge units 35 receives the supply of ink from one of the four ink cartridges. This makes it possible for one color of ink from among the four colors to be discharged from each of the discharge units 35, thus allowing for full-color printing.

Instead of being mounted onto the carriage 32, the ink cartridges may be ones that are installed at another location of the inkjet printer 1. The inkjet printer 1 may also be one that is further provided with an ink cartridge containing ink of a different color than the four aforementioned colors, or may be one that is provided solely with ink cartridges corresponding to some colors of the four colors (for example, that is provided solely with an ink cartridge corresponding to black).

The head unit 30 has a width not less than the width of the recording paper P in the Y-axis direction as seen in plan view, and, as stated above, the head unit 30 is equipped with the number M of discharge units 35, these M discharge units 35 being each equipped with one nozzle N. Namely, the number M of nozzles N (N[1], N[2], . . . , N[M]) are provided to the head unit 30.

The head unit 30 has four nozzle rows composed of a plurality of nozzles N extending in the lateral direction (Y-axis direction). Of the four nozzles rows, the yellow (Y) ink is discharged from each of the nozzles N included in a first nozzle row, the magenta (M) ink is discharged from each of the nozzles N included in a second nozzle row, the cyan (C) ink is discharged from each of the nozzles N included in a third nozzle row, and the black (K) ink is discharged from each of the nozzles N included in a fourth nozzle row.

Figure 3:
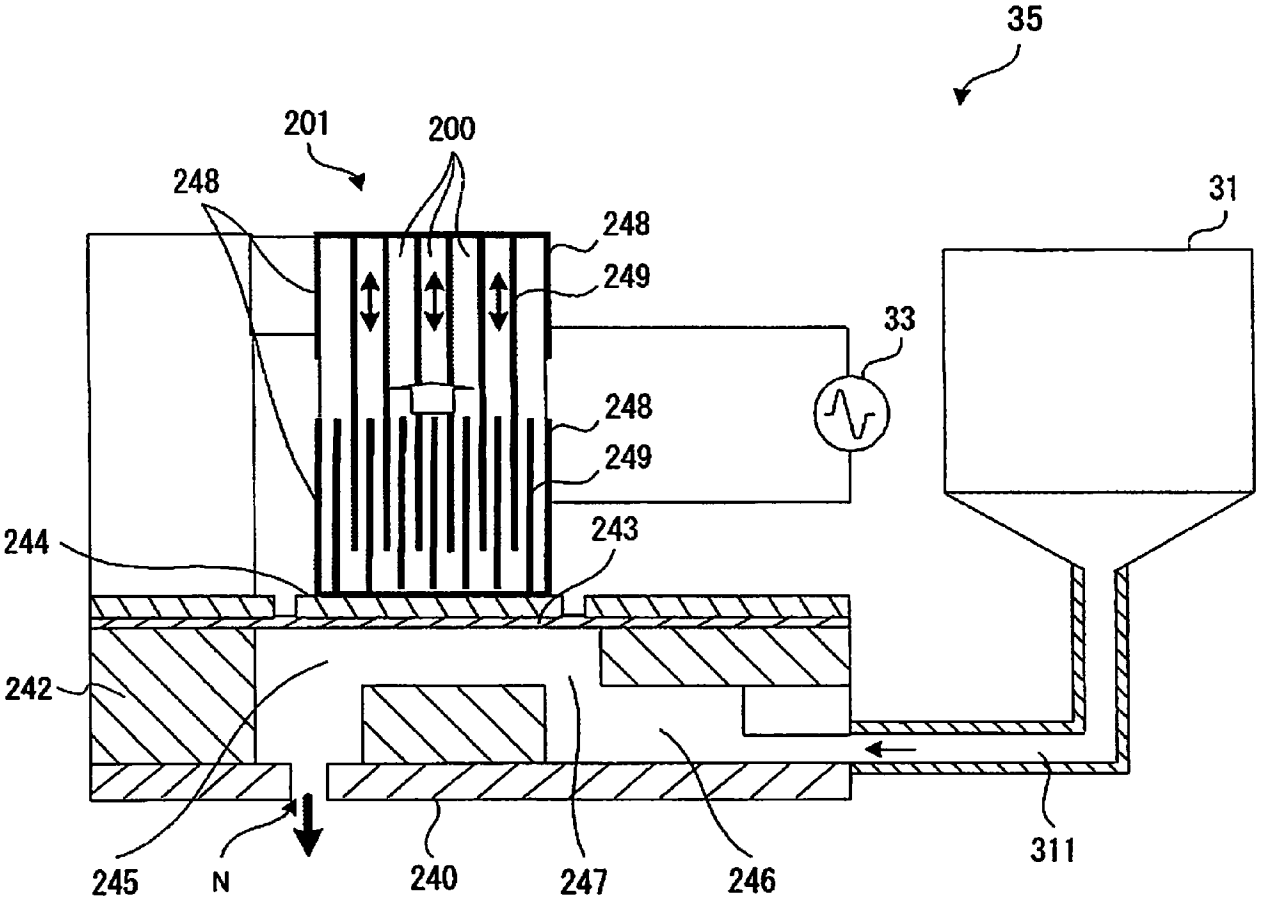
FIG. 3 is a schematic cross-sectional view illustrating one example of a head unit as in an embodiment.
Figure 4:
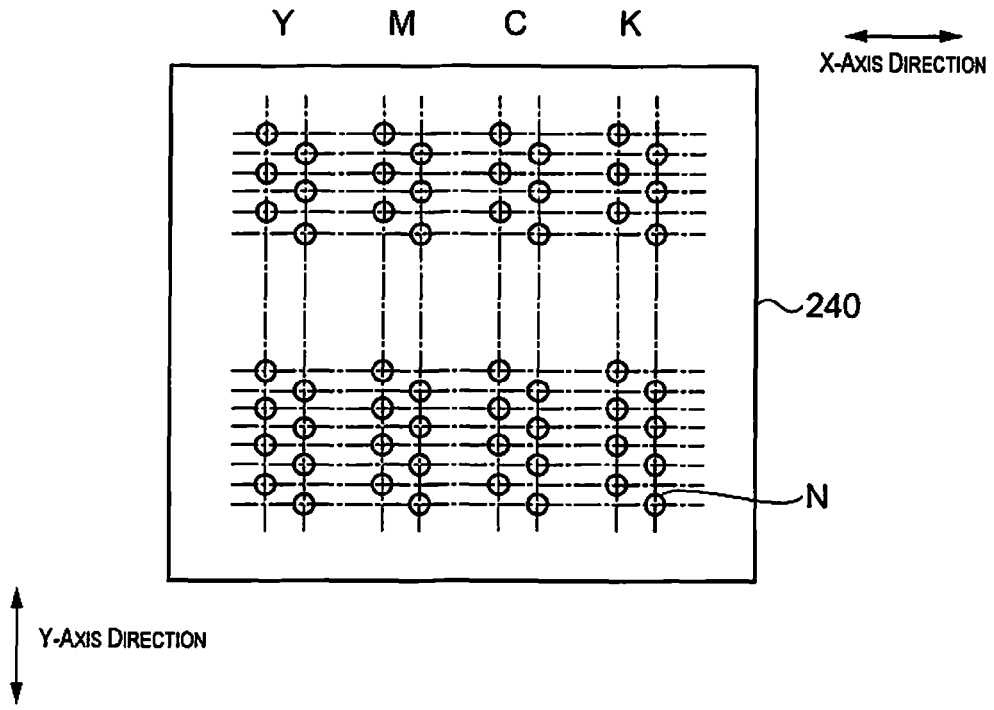
FIG. 4 is a plan view illustrating an arrangement pattern of nozzles.

Next, the configurations of the head unit 30 and of the discharge units 35 provided to the head unit 30 shall be described, with reference to FIGS. 3 and 4.

FIG. 3 is a schematic cross-sectional view of each of the discharge units 35 provided to the head unit 30. The discharge unit 35 illustrated in FIG. 3 is one where ink (liquid) inside a cavity 245 is discharged from the nozzle N by the driving of piezoelectric elements 200. This discharge unit 35 is provided with a nozzle plate 240 on which the nozzle N is formed, a cavity plate 242, and a laminated piezoelectric element 201 formed by laminating a plurality of piezoelectric elements 200 provided with a diaphragm 243. The cavity 245 is also called a pressure chamber.

The cavity plate 242 is shaped into a predetermined shape (such a shape that a recess is formed), and the cavity 245 is thereby formed, as is a reservoir 246. The cavity 245 and the reservoir 246 are communicated via an ink supply port 247. The reservoir 246 is also communicated to the ink cartridge via an ink supply tube 311.

What is a lower end of the laminated piezoelectric element 201 in FIG. 3 is bonded to the diaphragm 243 via an intermediate layer 244. Bonded to the laminated piezoelectric element 201 are a plurality of external electrodes 248 and internal electrodes 249. Namely, the external electrodes 248 are bonded to an outer surface of the laminated piezoelectric element 201, and the internal electrodes 249 are installed between each of the piezoelectric elements 200 that constitute the laminated piezoelectric element 201 (or, alternatively, are installed on the interior of each of the piezoelectric elements). In such a case, some of the external electrodes 248 and internal electrodes 249 are alternately arranged so as to overlap in the thickness direction of the piezoelectric elements 200.

Then, applying a drive voltage waveform from a drive signal generation unit 33 to between the external electrodes 248 and the internal electrodes 249 causes the laminated piezoelectric element 201 to deform (expand and contract in the up-down direction in FIG. 3) and vibrate as illustrated with the arrows in FIG. 3; this vibration causes the diaphragm 243 to vibrate. This vibration of the diaphragm 243 causes the volume of the cavity 245 (the pressure inside the cavity) to change, and causes the ink (liquid) that is contained inside the cavity 245 to be discharged as a liquid from the nozzle N. As such, the drive signal generation unit 33 functions as a drive unit for outputting a drive signal to the piezoelectric elements 200. The amount of liquid by which the liquid in the cavity 245 was reduced by the discharging of the liquid is replenished with ink supplied from the reservoir 246. Ink is also supplied to the reservoir 246 from the ink cartridge via the ink supply tube 311.

The arrayed pattern of nozzles N formed on the nozzle plate 240 illustrated in FIG. 3 is arranged with a stepwise offset as with, for example, the nozzle arrangement pattern illustrated in FIG. 4. The pitch between these nozzles N is one that can be set as appropriate in accordance with the printing resolution (dots per inch (dpi)). FIG. 4 illustrates an arrangement pattern of the nozzles N in a case where four colors of ink (ink cartridges) have been applied.

Figure 5:
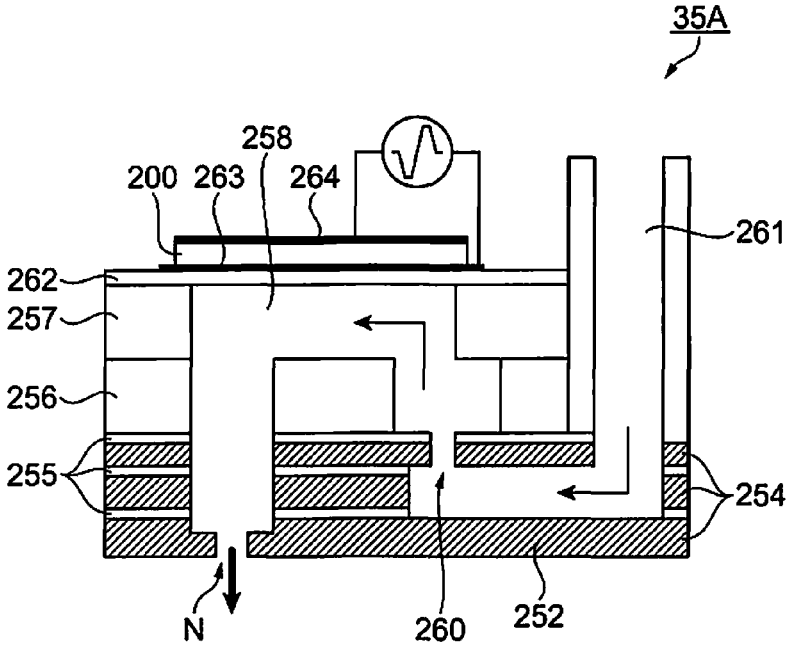
FIG. 5 is a schematic cross-sectional view illustrating a configuration illustrating another example of a head unit.

Next, other examples of the discharge units 35 shall be described. A discharge unit 35A illustrated in FIG. 5 is one where driving of the piezoelectric element 200 causes a diaphragm 262 to vibrate, thus causing the ink (liquid) inside a cavity 258 to be discharged from the nozzle N. A metal plate 254 made of stainless steel is bonded via an adhesive film 255 to a nozzle plate 252 made of stainless steel, on which a nozzle (hole) is formed; a similar metal plate 254 made of stainless steel is also bonded thereonto via another adhesive film 255. Also bonded sequentially thereonto are a communication port-forming plate 256 and a cavity plate 257. The cavity 258 is also called a pressure chamber.

The nozzle plate 252, the metal plates 254, the adhesive films 255, the communication port-forming plate 256, and the cavity plate 257 are shaped each in a predetermined shape (such shapes that a recess is formed), and the cavity 258 is formed by superimposing same, as is a reservoir 259. The cavity 258 and the reservoir 259 are communicated via an ink supply port 260. The reservoir 259 is also communicated to an ink intake port 26.

The diaphragm is installed on an upper surface opening section of the cavity plate 257, and the piezoelectric element 200 is bonded to the diaphragm 262 via a lower electrode 263. An upper electrode 264 is bonded to the opposite side of the piezoelectric element 200 to the lower electrode 263. By applying (supplying) the drive voltage waveform to between the upper electrode 264 and the lower electrode 263, the drive signal generation unit 33 causes the piezoelectric element 200 to vibrate, and causes the diaphragm 262 that is bonded thereto to vibrate. This vibration of the diaphragm 263 causes the volume of the cavity 258 (the pressure inside the cavity) to change, and causes the ink (liquid) that is contained inside the cavity 258 to be discharged as a liquid from the nozzle N.

The amount of liquid by which the liquid in the cavity 258 was reduced by the discharging of the liquid is replenished with ink supplied from the reservoir 259. Ink is also supplied to the reservoir 259 from the ink intake port 261.

Figures 6A, 6B, 6C:
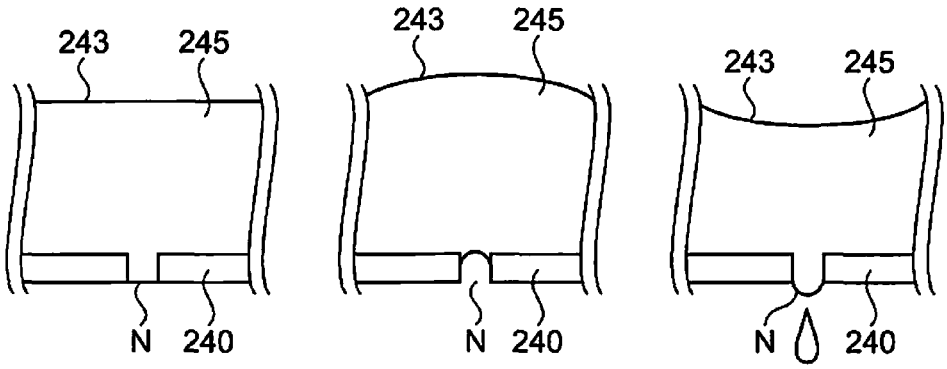
FIGS. 6A to 6C are descriptive views for describing a change in cross-sectional shape of a head unit during supply of a drive signal Vin.

Next, the discharging of the ink droplets shall be described, with reference to FIGS. 6A to 6C. A Coulomb force is generated between the electrodes when the drive voltage is applied to the piezoelectric element(s) 200 illustrated in FIG. 3 (FIG. 5) from the drive signal generation unit 33; the diaphragm 243 (262) deflects upward in FIG. 3 (FIG. 5) with respect to the initial state illustrated in FIG. 6A, and the volume of the cavity 245 (258) expands as illustrated in FIG. 6B. In this state, when the drive voltage is changed by control of the drive signal generation unit 33, then the diaphragm 243 (262) is restored to the original state by the elastic restoring force thereof, and moves downward beyond where the diaphragm 243 (262) was positioned in the initial state, thus causing rapid contraction of the volume of the cavity 245 (258), as illustrated in FIG. 6C. The compression pressure generated inside the cavity 245 (258) at this time causes some of the ink (liquid material) that fills the cavity 245 (258) to be discharged in the form of ink droplets from the Nozzle N, which is communicated to the cavity 245 (258).

The diaphragm 243 of each of the cavities 245 undergoes damped vibration during the period after this series of ink discharge operations is completed and until the next ink discharge operations are started. This damped vibration shall hereinbelow also be called residual vibration. The residual vibration of the diaphragm 243 is assumed to be one that has a natural resonance frequency that is defined by the shape of the nozzle N or ink supply port 247 or the acoustic resistance r from the viscosity of the ink and the like, an inertance m from the weight of ink in the flow path, and a compliance Cm of the diaphragm 243.

A computational model of the residual vibration of the diaphragm 243 that is based on the above assumption shall now be described.

Figure 7:
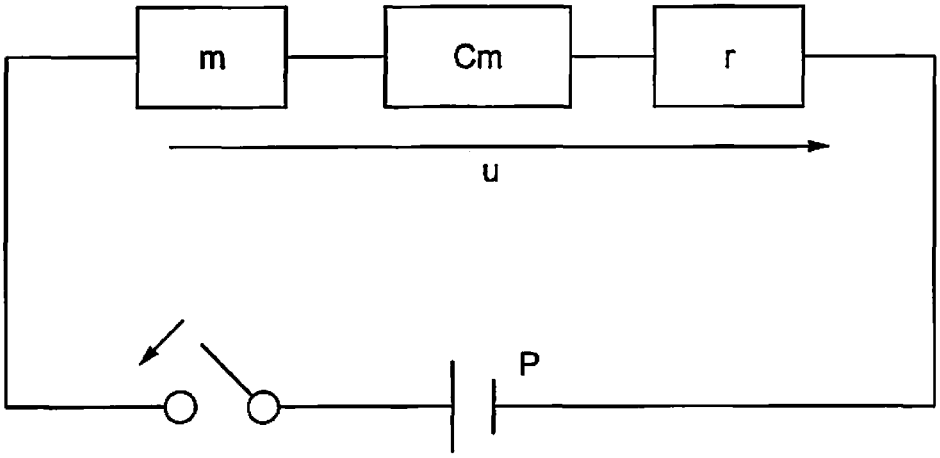
FIG. 7 is a circuit diagram illustrating a model of simple harmonic motion representative of the residual vibration in a discharge unit.

FIG. 7 is a circuit diagram illustrating a computational model of simple harmonic motion that assumes the residual vibration of the diaphragm 243.

In this manner, the computational model of the residual vibration of the diaphragm 243 can be expressed by a sound pressure p, and the aforementioned inertance m, compliance Cm, and acoustic resistance r. The following formula is obtained when a step response of when the sound pressure p is applied to the circuit of FIG. 7 is calculated for a volume velocity u.

$$u=\{p/(\omega\cdot m)\}e-\omega t\cdot\sin(\omega t)$$

$$\omega=\{1/(m\cdot Cm)-\alpha 2\}^{1/2}$$

$$\alpha=r/(2m)$$

Figure 8:
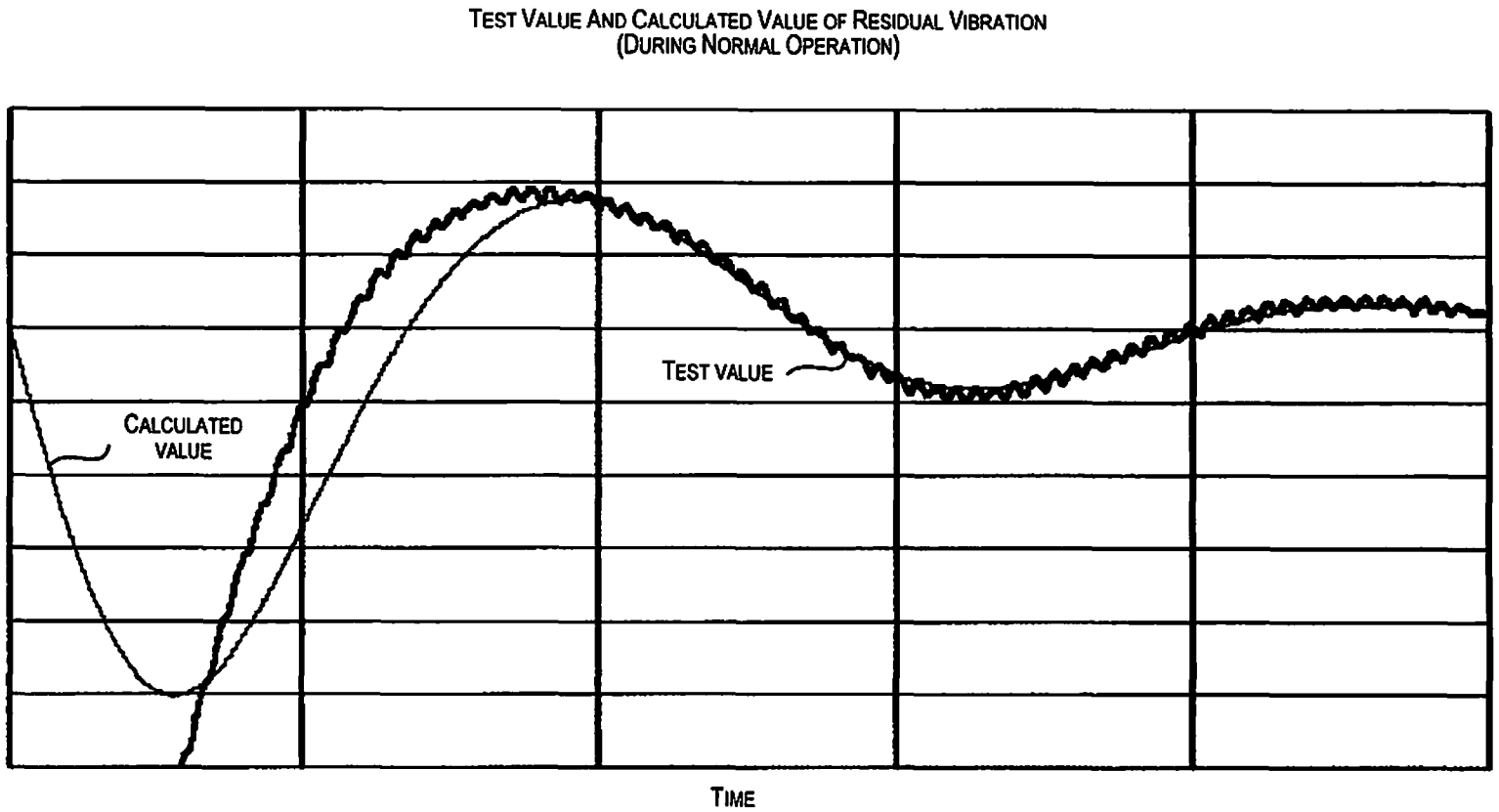
FIG. 8 is a graph illustrating a relationship between a test value and calculated value in a case where the state of discharge in a discharge unit is normal.

The calculation result obtained from this formula and a test result in a test of the residual vibration of the diaphragm 243 after the discharge of the ink droplets that was carried out separately shall be compared. FIG. 8 is a graph illustrating the relationship between the test value and calculated value of the residual vibration of the diaphragm 243. As will also be readily understood from the graph illustrated in FIG. 8, the two waveforms of the test value and the calculated value are generally consistent with one another. Herein, to summarize the head as a whole, the head has the diaphragms 243 (262), the piezoelectric elements 200 that cause the diaphragms 243 (262) to vibrate, the pressure chambers in which the pressure of the interior is increased and decreased by the vibration of the diaphragms 243 (262), and the nozzles N that communicate with the pressure chambers and allow for the liquid inside the pressure chambers to be discharged by the increase and decrease in pressure of the pressure chambers.

Now, in a discharge unit 35, there in some instances occurs a phenomenon where the ink droplets are not normally discharged from the nozzle N despite the fact that the discharge operations as have been described above have been carried out, i.e., a liquid discharge malfunction. Possible causes for why this discharge malfunction might occur include: (1) entry of air bubbles into the cavity 245; (2) drying and thickening (sticking fast) of the ink in the vicinity of the nozzle N; (3) adhesion of paper dust to the vicinity of the exit of the nozzle N; and so forth.

As a consequence of when this discharge malfunction occurs, typically the liquid is not discharged from the nozzle N, i.e., a liquid discharge failure phenomenon manifests; in such a case, the pixel in the image that is printed will have dot loss. Moreover, in the event of a discharge malfunction, the liquid might still be discharged from the nozzle N, and yet the ink droplet does not land properly either because the amount of liquid is too little or because the direction of flight of the liquid (the landing thereof) is offset; therefore, the pixel will have dot loss all the same. In view thereof, in the description that follows, liquid discharge malfunction may in some instances also be referred to as simple "dot loss".

Hereinbelow, the value of the acoustic resistance r and/or of the inertance m is adjusted so that the test value and measured value of the residual vibration of the diaphragm 243 will match (generally be consistent with) one another, an adjustment that is made separately depending on the cause of the dot loss (discharge malfunction) phenomenon (liquid discharge failure phenomenon) during the printing process that takes place at the discharge units 35, based on the comparison result illustrated in FIG. 8.

Figure 9:
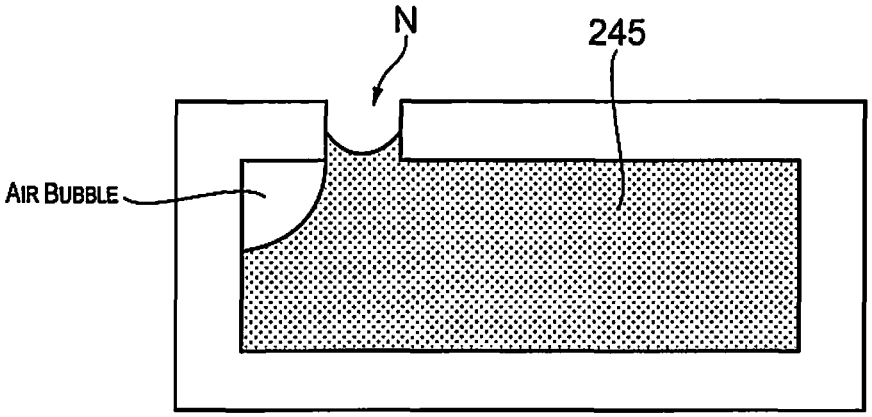
FIG. 9 is a descriptive view illustrating the state of a discharge unit in a case where air bubbles have entered a cavity interior.

First there shall be an investigation of (1) the entry of air bubbles into the cavity 245, which is one of the causes of dot loss. FIG. 9 is a conceptual view of the vicinity of the nozzle N in a case where an air bubble has entered into the cavity 245. As illustrated in FIG. 9, the air bubble generated is assumed to have occurred by adhering to a wall surface of the cavity 245.

In a case where an air bubble has entered into the cavity 245 in this manner, it is thought that the total weight of ink that fills the cavity 245 is reduced and the inertance m is decreased. As also illustratively exemplified in FIG. 9, it is believed that a case where an air bubble has adhered to the vicinity of the nozzle N marks a state where the diameter of the nozzle N has increased commensurate with the magnitude of the diameter of the air bubble, thus decreasing the acoustic resistance r.

Figure 10:
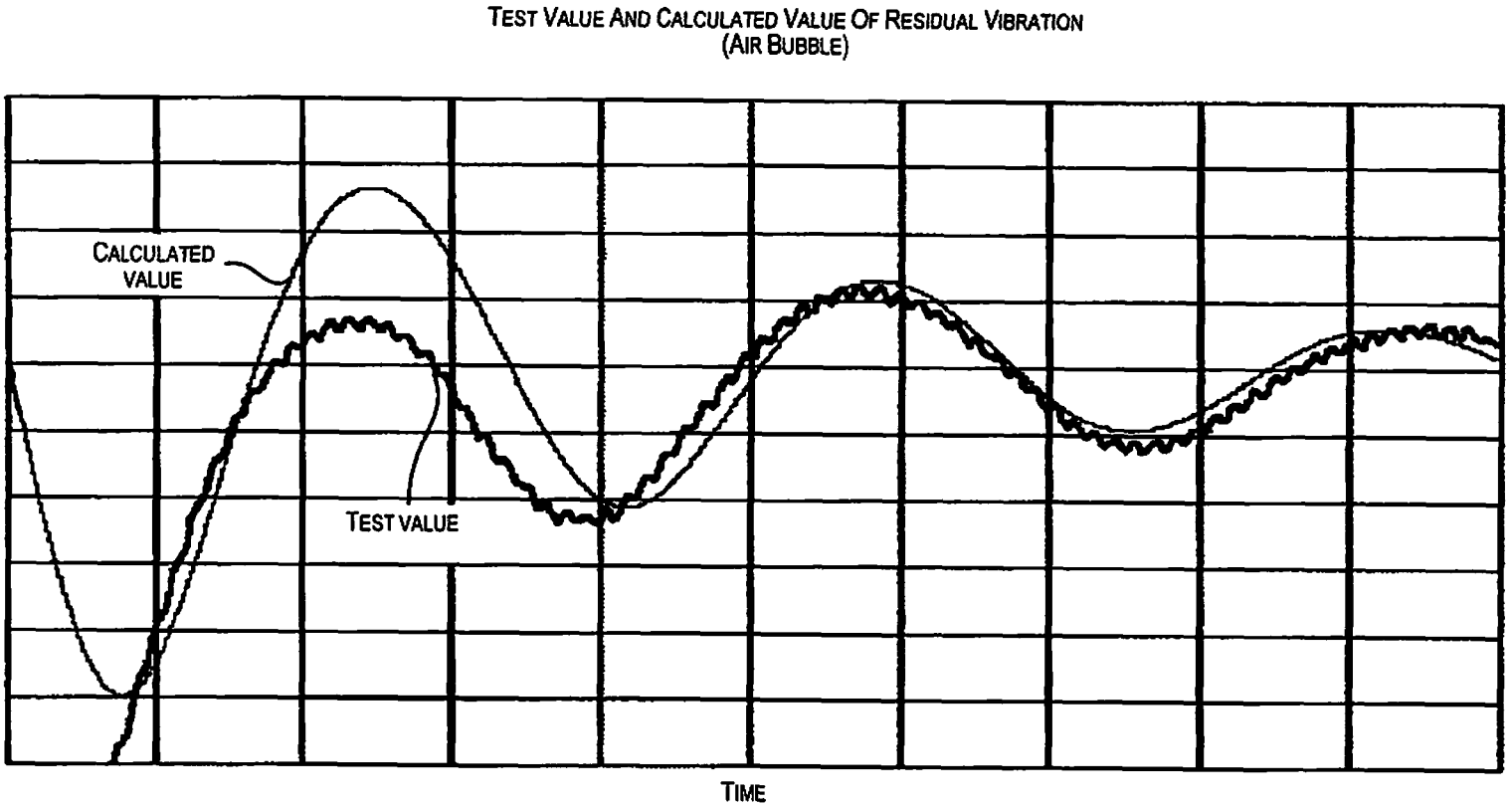
FIG. 10 illustrates a test value and calculated value of the residual vibration in a state where air bubbles entering a cavity interior have made it impossible to discharge the ink.

As such, with respect to the case in FIG. 8 where the ink is discharged normally, the acoustic resistance r and the inertance m are both set so as to be lower, to match with the test value of the residual vibration during air bubble entry, thereby producing a result (graph) as per FIG. 10. As will be readily understood from the graphs in FIGS. 8 and 10, in a case where an air bubble has entered into the cavity 245, then a characteristic residual vibration waveform where the frequency is higher than during normal discharge is obtained. It is also possible to confirm that the attenuation factor of the amplitude of the residual vibration is also reduced due in part to the decrease in the acoustic resistance r, and that the residual vibration experiences a slow drop in amplitude.

Figure 11:
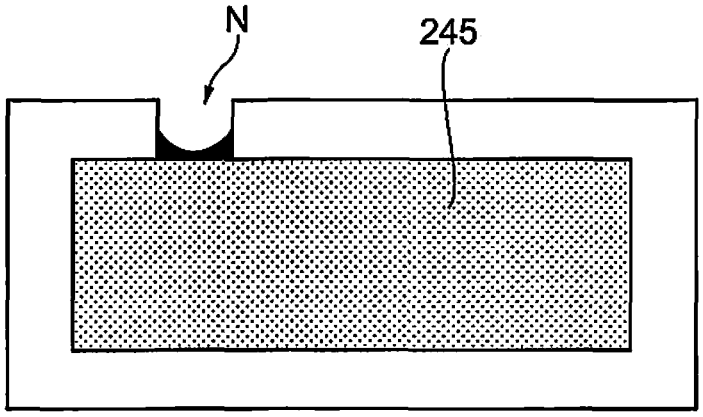
FIG. 11 is a descriptive view illustrating the state of a discharge unit in a case where ink in the vicinity of a nozzle has stuck fast.

Next there shall be investigation of (2) drying (sticking fast, thickening) of the ink in the vicinity of the nozzle N, which is another one of the causes of dot loss. FIG. 11 is a conceptual view of the vicinity of the nozzle N in a case where the ink in the vicinity of the nozzle N in FIG. 4 has stuck fast due to drying. As illustrated in FIG. 11, a case where ink in the vicinity of the nozzle N has dried and stuck fast becomes a situation where the ink inside the cavity 245 has become strapped inside the cavity 245. In the event that the ink in the vicinity of the nozzle N has dried and thickened in this manner, it is believed that the acoustic resistance r will increase.

Figure 12:
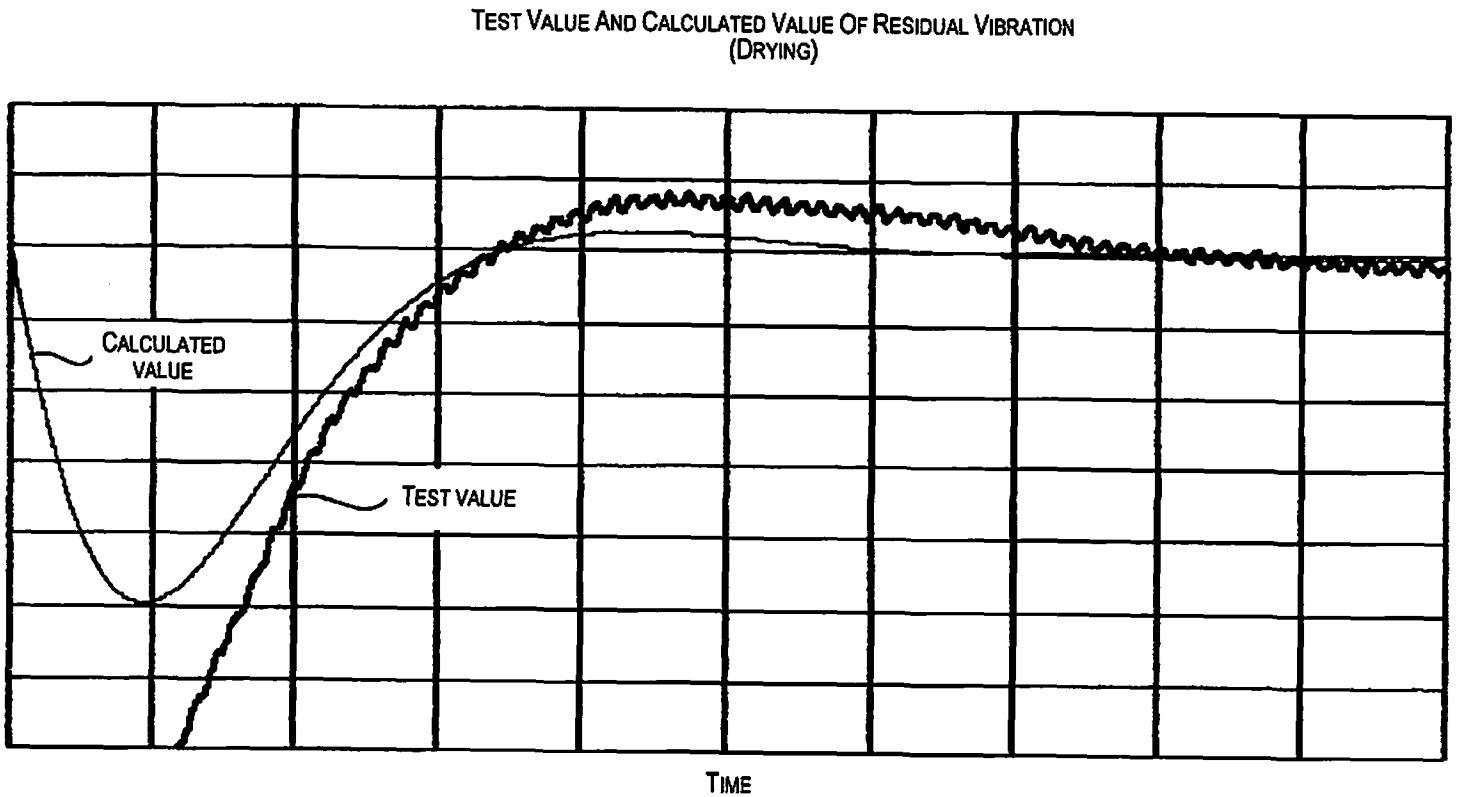
FIG. 12 is a graph illustrating a test value and calculated value of the residual vibration in a state where sticking fast of ink in the vicinity of a nozzle has made it impossible to discharge the ink.

As such, with respect to the case in FIG. 8 where the ink is discharged normally, the acoustic resistance r is set so as to be lower, to match with the test value of the residual vibration during drying and sticking fast (thickening) of ink in the vicinity of the nozzle N, thereby producing a result (graph) as per FIG. 12. The test value illustrated in FIG. 12 was obtained by measuring the residual vibration of the diaphragm 243 in a state where the discharge unit 35 was allowed to stand for several days while a cap (not shown) was left unattached and the ink in the vicinity of the nozzle N dried and thickened, thereby making it impossible to discharge the ink (a state where the ink had stuck fast). As will be readily understood from the graphs in FIGS. 8 and 12, in the event that drying has caused the ink in the vicinity of the nozzle N to stick fast, a characteristic residual vibration waveform where the frequency becomes extremely low as compared to during normal discharge and the residual vibration has become overdamped is obtained. This is because the diaphragm 243 has rapidly lost the ability to vibrate (has become overdamped), because there is no escape for the ink inside the cavity 245 when the diaphragm 243 moves upward in FIG. 4 after the ink has flowed into the cavity 245 from the reservoir 246 due to the diaphragm 243 being pulled downward in FIG. 4 in order to discharge the ink droplets.

Next there shall be investigation of (3) adhesion of paper dust to the vicinity of the exit of the nozzle N, which is yet another one of the causes of dot loss.

Figure 13:
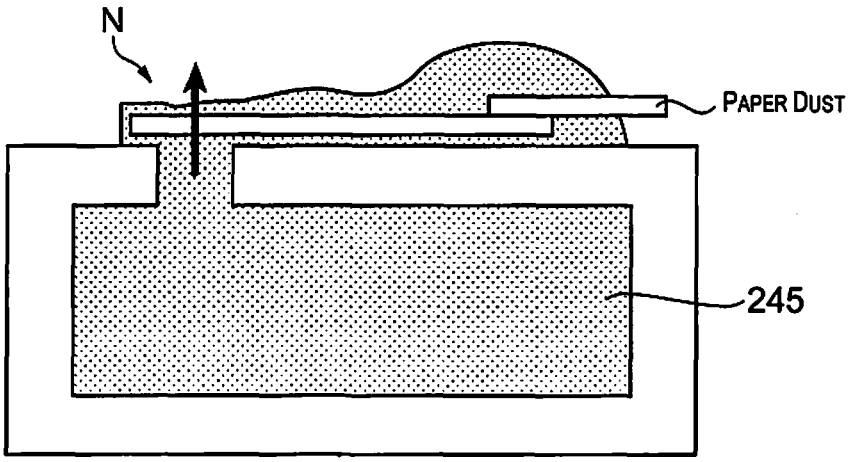
FIG. 13 is a descriptive view illustrating the state of a discharge unit in a case where paper dust has adhered to the vicinity of an exit of a nozzle.

FIG. 13 is a conceptual view of the vicinity of the nozzle N in a case where paper dust has adhered to the vicinity of the exit of the nozzle N in FIG. 4. As illustrated in FIG. 13, in a case where paper dust has adhered to the vicinity of the exit of the nozzle N, then the ink will end up seeping out from inside the cavity 245 via the paper dust, and it will become impossible to discharge the ink from the nozzle N. In a case where paper dust has adhered to the vicinity of the exit of the nozzle N and ink has seeped out from the nozzle N in this manner, then it is believed that the inertance m increases due to the fact that the ink that is inside the cavity 245 and the amount thereof that has seeped out, as seen from the diaphragm 243, are increased beyond what is normal. It is also thought that fibers of the paper dust that has adhered to the vicinity of the exit of the nozzle N cause the acoustic resistance r to increase.

Figure 14:
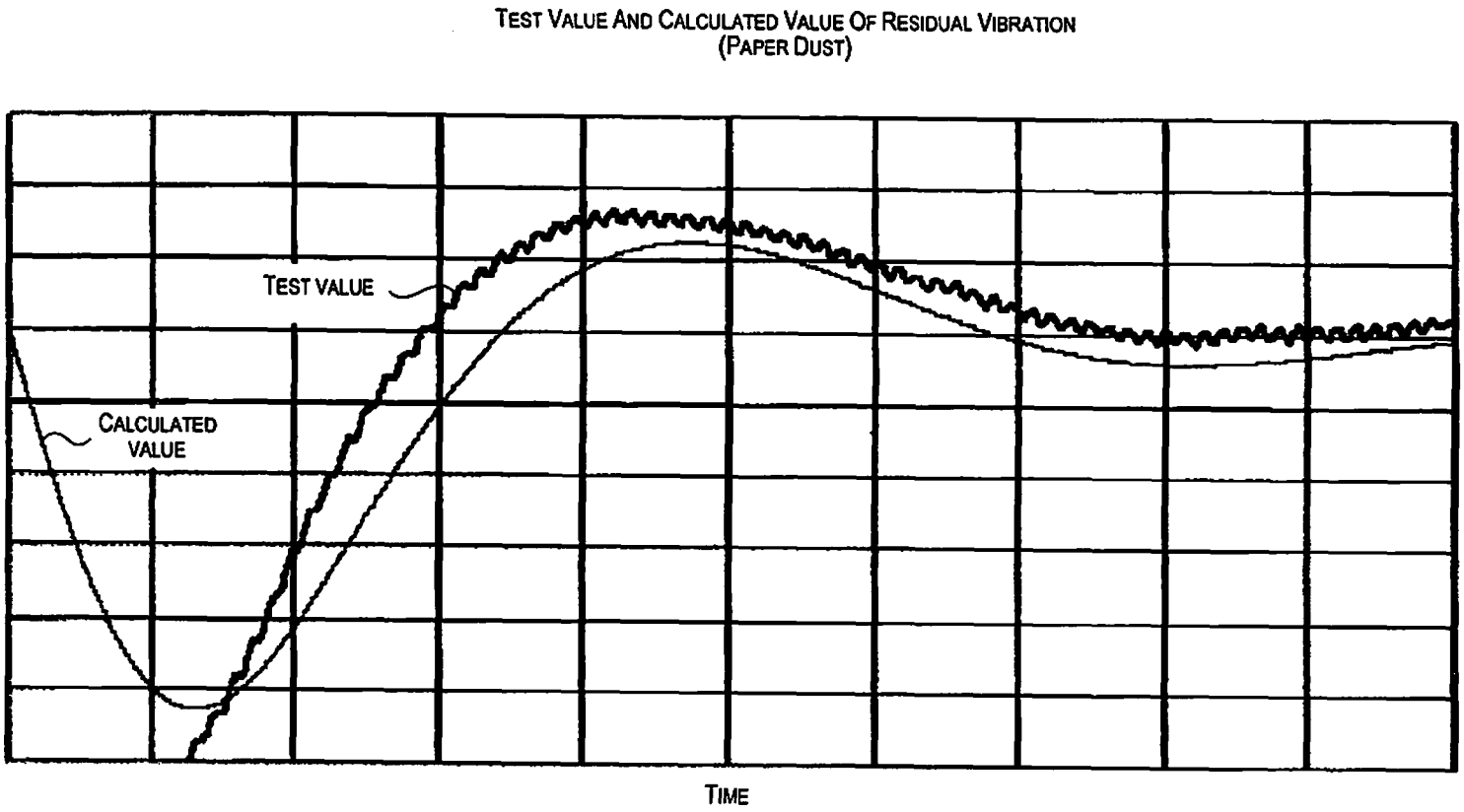
FIG. 14 is a graph illustrating a test value and calculated value of the residual vibration in a case where adhesion of paper dust to the vicinity of an exit of a nozzle has made it impossible to discharge the ink.

As such, with respect to the case in FIG. 8 where the ink is discharged normally, the inertance m and the acoustic resistance r are both set so as to be lower, to match with the test value of the residual vibration during adhesion of paper dust to the vicinity of the exit of the nozzle N, thereby producing a result (graph) as per FIG. 14. As will be readily understood from the graphs in FIGS. 8 and 14, in a case where paper dust has adhered to the vicinity of the exit of the nozzle N, a characteristic residual vibration waveform where the frequency has become lower as compared to during normal discharge is obtained.

In the light of the graphs illustrated in FIGS. 12 and 14, it shall be readily understood that the frequency of the residual vibration in the event of paper dust adhesion is higher than in the event of ink drying.

Herein, in both the case where ink in the vicinity of the nozzle N has dried and thickened and the case where paper dust has adhered to the vicinity of the exit of the nozzle N, the frequency of the damped vibration will be lower than the case where the ink droplets are discharged normally. In order to identify these two causes of dot loss (ink discharge failure; discharge malfunction) from the waveform of the residual vibration of the diaphragm 243, it is possible, for example, to make comparisons with a predetermined threshold value in the frequency, period, or phase of the damped vibration, or to identify the cause from the decay rate of the period change or amplitude change of the residual vibration (damped vibration). It is thus possible to detect a discharge malfunction of each of the discharge units 35 by the changes in the residual vibration of the diaphragm 243 and in particular the changes in the frequency thereof when the ink droplets are discharged from the nozzles N of each of the discharge units 35. Comparing the frequency of the residual vibration in such a case against the frequency of the residual vibration during normal discharge makes it possible also to identify the cause of the discharge malfunction.

The inkjet printer 1 as in the present embodiment is intended to analyze the residual vibration and sense a discharge malfunction.

Next, configurations and operations of the head driver 50 (the drive signal generation unit 51, the discharge malfunction detection unit 52, and the switching unit 53) shall be described, with reference to FIGS. 15 to 22.

Figure 15:
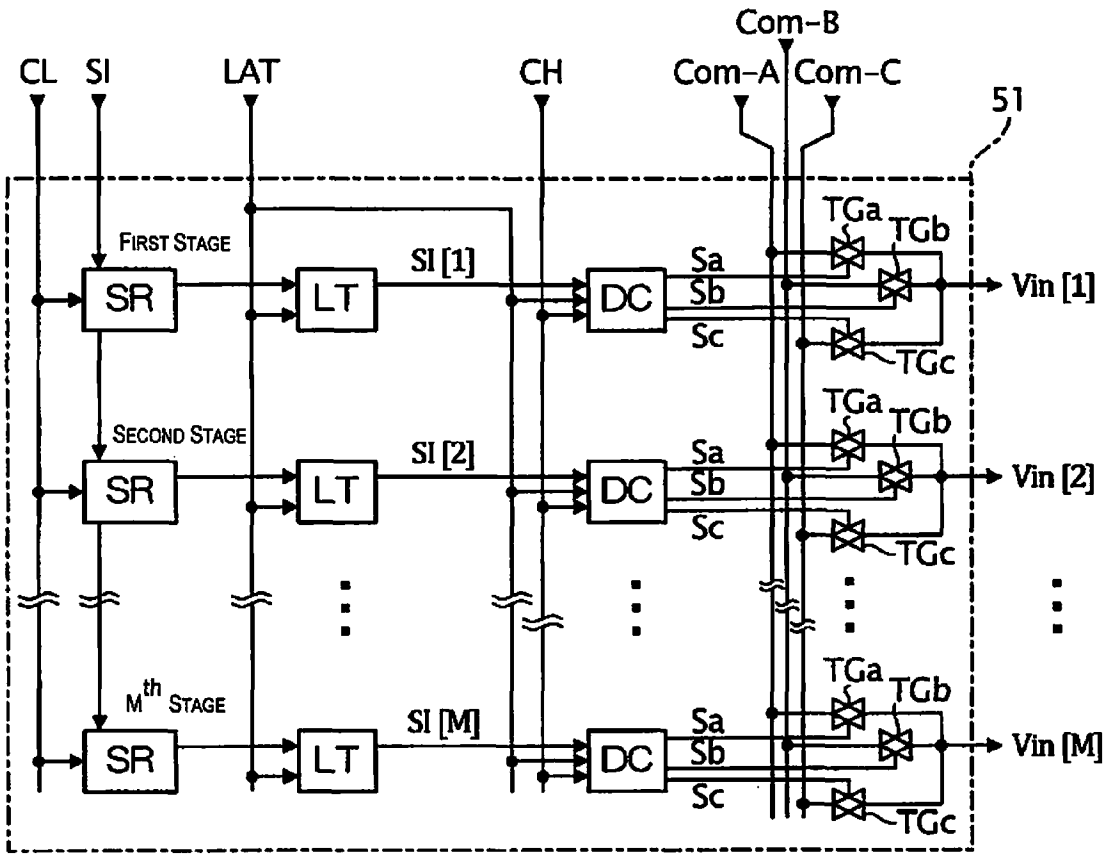
FIG. 15 is a block diagram illustrating the configuration of a drive signal generation unit.

FIG. 15 is a block diagram illustrating the configuration of the drive signal generation unit 51 that forms part of the head driver 50. As illustrated in FIG. 15, the drive signal generation unit 51 has, in one-to-one correspondence with the number M of discharge units 35, a number M of sets composed of a shift register SR, a latch circuit LT, a decoder DC, and transmission gates TGa, TGb, and TGc. Below, each of the elements that constitute this number M of sets shall in some instances be called a first stage, a second stage, . . . , and an M-th stage, in order from the top in the drawing.

A more detailed description shall follow, but the discharge malfunction detection unit 52 is equipped with a number M of discharge malfunction detection circuits DT (the DT[1], DT[2], . . . , DT[M] illustrated in FIG. 22) so as to have a one-to-one correspondence with the number M of discharge units 35.

A clock signal CL, the print signal SI, a latch signal LAT, a change signal CH, and the drive waveform signals Com (Com-A, Com-B, Com-C) are supplied to the drive signal generation unit 51 from the control unit 6.

Herein, the "print signal SI" refers to a digital signal that regulates the amount of ink that is discharged from each of the discharge units 35 (each of the nozzles N) when one dot of the image is being formed. More specifically, the print signal SI as in the present embodiment is one with which the amount of ink that is discharged from each of the discharge units 35 (each of the nozzles N) is regulated with an upper bit b1, a middle bit b2, and a lower bit b3, and is supplied serially to the drive signal generation unit 51 from the control unit 6 in synchronization with the clock signal CL. The control of the amount of ink that is discharged from each of the discharge units 35 by the print signal SI makes it possible to render four gradations—non-recording, small dot, medium dot, and large dot—in each of the dots of the recording paper P, and also makes it possible to generate an inspection drive signal for generating the residual vibration and inspecting the state of discharge of the ink.

Each of the shift registers SR temporarily retains the print signal SI for every one of the three bits corresponding to each of the discharge units 35. More specifically, the number M of shift registers SR of the first stage, the second stage, . . . , and the M-th stage having one-to-one correspondence with the number M of discharge units 35 are connected in a cascade to one another, and also the print signal SI is transferred to the subsequent stage in accordance with the clock signal CL. At a point in time where the print signal SI has been transferred to all of the number M of shift registers SR, then the supply of the clock signal CL is stopped, and a state where each of the number M of shift registers SR retains data amounting to the three bits corresponding to itself out of the print signal SI is maintained.

Each of the number M of latch circuits LT latches concurrently the print signal SI amounting to the three bits corresponding to each of the stages, retained in each of the number M of shift registers M, at a timing where the latch signal LAT rises up. In FIG. 15, the SI[1], SI[2], . . . , SI[M] each respectively illustrate the print signal SI amounting to the three bits having been respectively latched by the latch circuits corresponding to the shift registers SR of the first stage, the second stage, . . . , and the M-th stage.

A print operation period, which is a period during which the inkjet printer 1 prints by forming an image on the recording paper P, is composed of a plurality of unit operation periods Tu.

The control unit 6 assigns the unit operation periods Tu to either the printing process or the discharge malfunction detection process for each of the number M of discharge units 35. The control unit 6 controls the discharge units 35 in three modes. The first mode is to assign the printing process to some of the number M of discharge units 35, and assign the discharge malfunction detection process to the remainder. The second mode is to assign the printing process to all of the number M of discharge units 35. The third mode is to assign the discharge malfunction detection process to all of the number M of discharge units 35.

Each of the unit operation periods Tu is composed of a control period Tc1 and another control period Tc2 subsequent thereto.

In the present embodiment, the control periods Tc1 and Tc2 have mutually equal time lengths.

The control unit 6 supplies the print signal SI to the drive signal generation unit 51 in every one of the unit operation periods Tu, and the latch circuit LT latches the print signal SI[1], SI[2], . . . , SI[M] in every one of the unit operation periods Tu.

The decoders DC decode the print signal SI amounting to the three bits latched by the latch circuits LT, and output selection signals Sa, Sb, and Sc in each of the control periods Tc1 and Tc2.

FIG. 16 is a descriptive view (table) illustrating the content of the decoding carried out by the decoders DC. As illustrated in FIG. 16, in a case where the content indicated by a print signal SI[m] corresponding to an m-th stage (where m is a natural number satisfying $1 \leq m \leq M$) is, for example, (b1, b2, b3)=(1, 0, 0), then the decoder DC of the m-th stage sets the selection signal Sa to a high level H and also sets the selection signals Sb and Sc to a low level L during the control period Tc1, and sets the selection signals Sa and Sc to the low level L and also sets the selection signal Sb to the high level H during the control period Tc2.

In a case where the lower bit b3 is "1", then, irrespective of the values of the upper bit b1 and the middle bit b2, the decoder DC of the m-th stage sets the selection signals Sa and Sb to the low level L and also sets the selection signal Sc to the high level H during the control periods Tc1 and Tc2.

The description returns now to FIG. 15. As illustrated in FIG. 15, the drive signal generation unit 51 is provided with a number M of sets of transmission gates TGa and TGb so as to have one-to-one correspondence with the number M of discharge units 35.

The transmission gates TGa turn on when the selection signal Sa is the H-level, and turn off when the selection signal Sa is the L-level. The transmission gates TGb turn on when the selection signal Sb is the H-level, and turn off when the selection signal Sb is the L-level. The transmission gates TGc turn on when the selection signal Sc is the H-level, and turn off when the selection signal Sc is the L-level.

In an example of a case where the content indicated by the print signal SI[m] is (b1, b2, b3)=(1, 0, 0) in the m-th stage, then the transmission gate TGa turns on and the transmission gates TGb and TGc turn off in the control period Tc1, and the transmission gates TGa and TGc turn off and the transmission gate TGb turns on in the control period Tc2.

The drive waveform signal Com-A is supplied to one end of the transmission gate TGa, the drive waveform signal Com-B is supplied to one end of the transmission gate TGb, and the drive waveform signal Com-C is supplied to one end of the transmission gate TGc. The other ends of the transmission gates TGa, TGb, and TGc are connected to one another.

The transmission gates TGa, TGb, and TGc are exclusively turned on, and the drive waveform signal Com-A, Com-B, or Com-C selected for every one of the control periods Tc1 and Tc2 is outputted as the drive signal Vin[M] and in turn supplied to the discharge unit 35 of the m-th stage via the switching unit 53.

Figure 17:
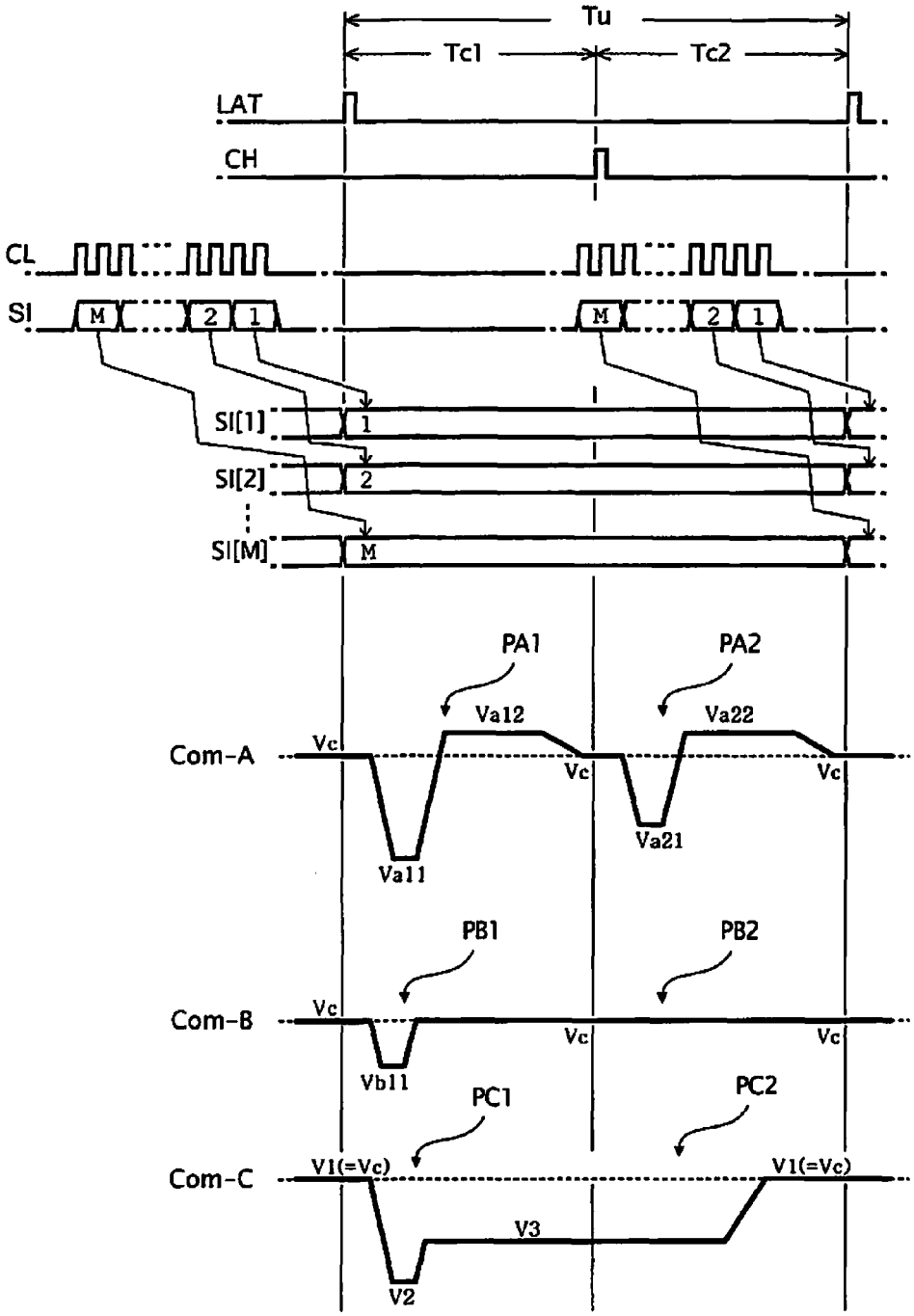
FIG. 17 is a timing charge illustrating the operation of a drive signal generation unit during a unit operation period.

FIG. 17 is a timing chart for describing the operation of the drive signal generation unit 51 in the unit operation period Tu. As illustrated in FIG. 17, the unit operation period Tu is defined by the latch signal LAT outputted by the control unit 6. Each of the unit operation periods Tu is composed of the control periods Tc1 and Tc2 of equal time length to one another, which are defined by the latch signal LAT and the change signal CH.

As illustrated in FIG. 17, the drive waveform signal Com-A supplied from the control unit 6 in the unit operation period Tu is a waveform in which, of the unit operation period Tu, a unit waveform PA1 arranged in the control period Tc1 and a unit waveform PA2 arranged in the control period Tc2 are continuous with one another. The electrical potential at the timing of the start and end of the unit waveform PA1 and the unit waveform PA2 is in all cases a reference potential Vc. Also, as is illustrated in FIG. 17, the potential difference between a potential Val 1 and potential Va12 of the unit waveform PA1 is greater than the potential difference between a potential Va21 and potential Va22 of the unit waveform PA2. For this reason, in a case where the piezoelectric elements 200 provided to each of the discharge units 35 are driven by the unit waveform PA1, then the amount of ink that is discharged from the nozzles N provided to these discharge units 35 is greater than the amount of ink that is discharged in a case where the piezoelectric elements 200 are driven by the unit waveform PA2.

The drive waveform signal Com-B supplied from the control unit 6 in the unit operation period Tu is a waveform in which a unit waveform PB1 arranged in the control period Tc1 and a unit waveform PB2 arranged in the control period Tc2 are continuous with one another. The electrical potential at the timing of the start and end of the unit waveform PB1 is in both cases the reference potential Vc, and the unit waveform PB2 is maintained at the reference potential Vc throughout the control period Tc2. The potential difference between a potential Vb11 of the unit waveform PB1 and the reference potential Vc is greater than the potential difference between the potential Va21 and potential Va22 of the unit waveform PA2. Even in a case where the piezoelectric elements 200 provided to each of the discharge units 35 are driven by the unit waveform PB1, ink is still not discharged from the nozzles N provided to these discharge units 35. Similarly, ink shall not be discharged from the nozzles N in a case where the unit waveform PB2 is supplied to the piezoelectric elements 200, either.

The drive waveform signal Com-C supplied from the control unit 6 in the unit operation period Tu is a waveform in which a unit waveform PC1 arranged in the control period Tc1 and a unit waveform PC2 arranged in the control period Tc2 are continuous with one another. The electrical potential at the timing of the start of the unit waveform PC1 and the end of the unit waveform PC2 is in both cases a first potential V1 (which in this example is the reference potential Vc). The unit waveform PB1 transitions from the first potential V1 to a second potential V2, and furthermore transitions from the second potential V2 to a third potential V3, and then is maintained at the third potential V3. The unit waveform PB2 maintains the third potential V3, and thereafter transitions from the third potential V3 to the first potential V2, and is then maintained at the first potential V1. The drive waveform signal Com-C is selected when the state of discharge of the ink is being inspected. The first potential of this example (the reference potential Vc) has been set to a potential that needs to be retained in the piezoelectric elements 200 during non-discharge of ink.

As stated above, the number M of latch circuits LT output the print signal S1[1], S1[2], . . . , SI[M] at the timings where the latch signal LAT rises up, i.e., at the timings where the unit operation period Tu (Tp or Tt) is started.

The decoder DC of the m-th stage, as stated previously, outputs the selection signals Sa, Sb, and Sc based on the content of the table illustrated in FIG. 16 in each of the control periods Tc1 and Tc2, in accordance with the print signal SI[m].

The transmission gates TGa, TGb, and TGc of the m-th stage, as stated previously, select the drive waveform signal Com-A, Com-B, or Com-C based on the selection signals Sa, Sb, and Sc, and outputs the selected drive waveform signal Com as the drive signal Vin[M].

Figure 18:
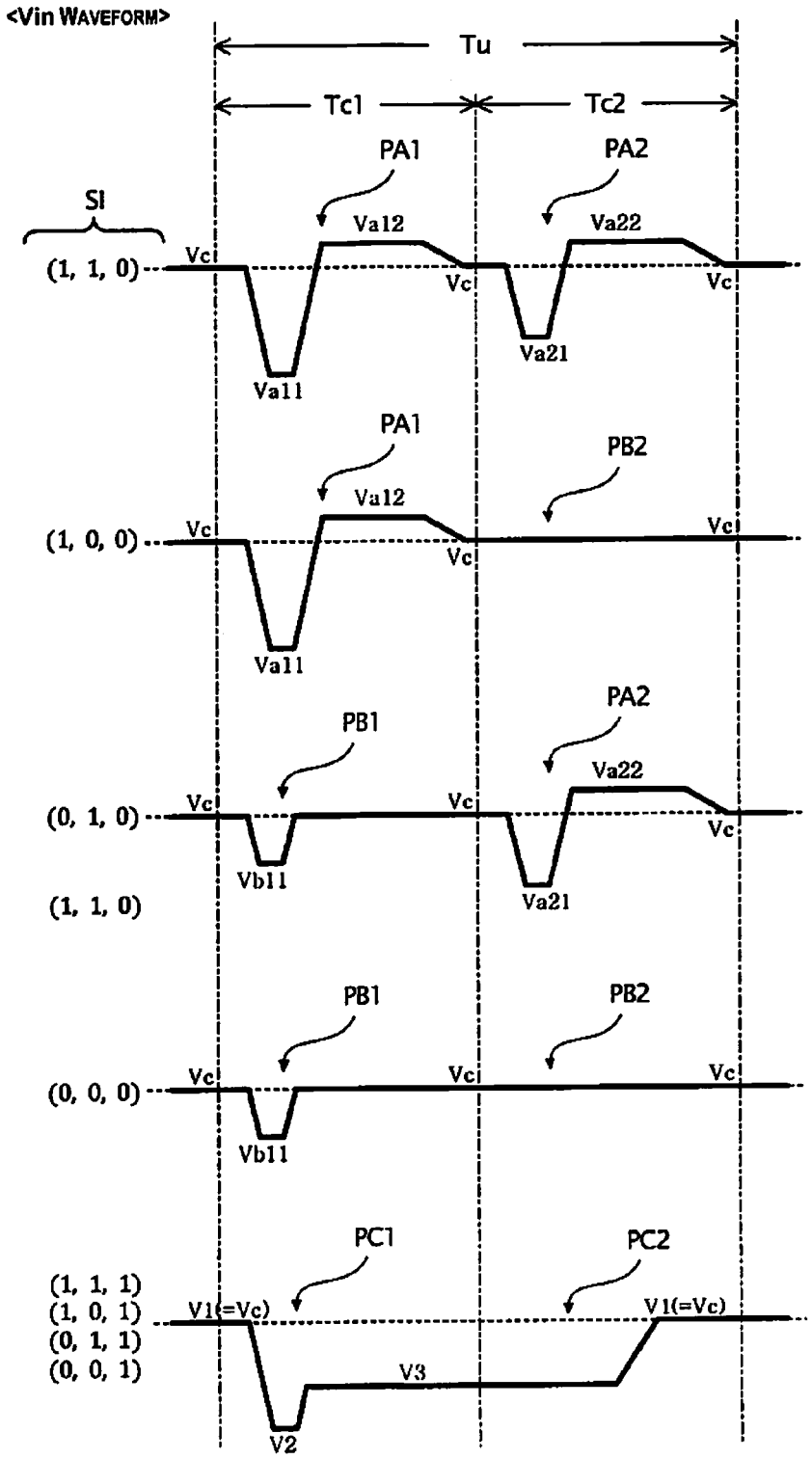
FIG. 18 is a timing chart representing the waveform of a drive signal in a unit operation period.

The waveform of the drive signal Vin outputted by the drive signal generation unit 51 in the unit operation period Tu shall now be described with reference to FIGS. 15 to 17 and, in addition thereto, FIG. 18.

In a case where the print signal SI[m] supplied in the unit operation period Tu is (b1, b2, b3)=(1, 1, 0), then the selection signals Sa, Sb, Sc will be the H-level, L-level, and L-level, respectively, in the control period Tc1 and the control period Tc2, and therefore the drive waveform signal Com-A is selected by the transmission gate TGa and, and the unit waveform PA1 and unit waveform PA2 are outputted as the drive signal Vin[M]. In the control period Tc2, the selection signals Sa, Sb, Sc will be the H-level, L-level, and L-level, respectively, and therefore the drive waveform signal Com-A is selected by the transmission gate TGa and the unit waveform PA2 is outputted as the drive signal Vin[M].

As a result, the discharge unit 35 of the m-th stage discharges a moderate amount of ink based on the unit waveform PA1 and discharges a small amount of ink based on the unit waveform PA2 during the unit operation period Tu; the ink that is discharged over these two rounds unite on the recording paper P, and therefore a large dot is formed on the recording paper P.

In a case where the content of the print signal SI[m] supplied in the unit operation period Tu is (b1, b2, b3)=(1, 0, 0), then the selection signals Sa, Sb, Sc will be the H-level, L-level, and L-level, respectively, in the control period Tc1, and therefore the drive waveform signal Com-A is selected by the transmission gate TGa and the unit waveform PA1 is outputted as the drive signal Vin[M]. In the control period Tc2, the selection signals Sa, Sb, Sc will be the L-level, H-level, and L-level, and therefore the drive waveform signal Com-B is selected by the transmission gate TGb, and the unit waveform PB2 is outputted as the drive signal Vin[M].

As a result thereof, the discharge unit 35 of the m-th stage discharges a moderate amount of ink based on the unit waveform PA1 in the unit operation period Tu, and a medium dot is formed on the recording paper P.

In a case where the content of the print signal SI[m] supplied in the unit operation period Tu is (b1, b2, b3)=(0, 1, 0), then the selection signals Sa, Sb, Sc will be the L-level, H-level, and L-level, respectively, in the control period Tc1, and therefore the drive waveform signal Com-B is selected by the transmission gate TGb, and the unit waveform PB1 is outputted as the drive signal Vin[M]. In the control period Tc2, the selection signals Sa, Sb, Sc will be the H-level, L-level, and L-level, respectively, and therefore the drive waveform signal Com-A is selected by the transmission gate TGa and the unit waveform PA2 is outputted as the drive signal Vin[M].

As a result of this, the discharge unit 35 of the m-th stage discharges a small amount of ink based on the unit waveform PA2 in the unit operation period Tu, and a small dot is formed on the recording paper P.

In a case where the content of the print signal SI[m] supplied in the unit operation period Tu is (b1, b2, b3)=(0, 0, 0), then the selection signals Sa, Sb, Sc will be the L-level, H-level, and L-level, respectively, in the control periods Tc1 and Tc2, and therefore the drive waveform signal Com-B is selected by the transmission gate TGb and the unit waveforms PB1 and PB2 are outputted as the drive signal Vin[M].

As a result of this, no ink is discharged from the discharge unit 35 of the m-th stage in the unit operation period Tu, and no dot is formed on the recording paper P (this is "non-recording").

In a case where the content of the print signal SI[m] supplied in the unit operation period Tu is (b1, b2, b3)=(1or0, 1or0, 1), then the selection signals Sa, Sb, Sc will be the L-level, L-level, and H-level, respectively, in the control periods Tc1 and Tc2, and therefore the drive waveform signal Com-C is selected by the transmission gate TGc, and the unit waveforms PC1 and PC2 are outputted as the drive signal Vin[M].

As a result of this, no ink is discharged from the discharge unit 35 of the m-th stage in the unit operation period Tu; rather, the state of discharge of the ink is inspected.

Figure 19:
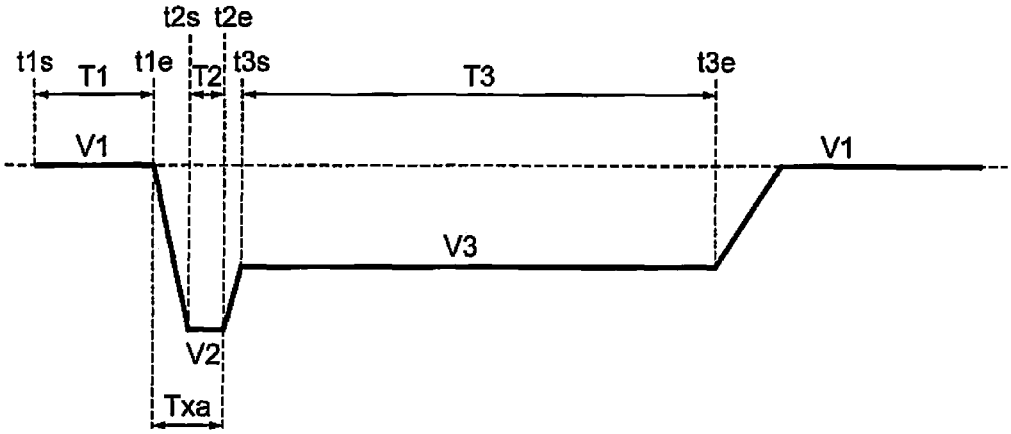
FIG. 19 is a waveform diagram illustrating the waveform of an inspection drive signal.

FIG. 19 illustrates the waveform of the inspection drive signal Vin[M]. As illustrated in FIG. 19, the drive signal Vin[M] will be the first potential V1 during a first period T1 from a time t1*s* until a time t1*e*, will be the second potential V2 during a second period T2 from a time t2*s* until a time t2*e*, and will be the third potential V3 during a third period T3 from a time t3*s* until a time t3*e*. The drive signal Vin[M] transitions from the first potential V1 to the second potential V2 (t1*e* to t2*s*), and transitions from the second potential V2 to the third potential V3 (t2*e* to t3*s*).

In this example, a charge with which the piezoelectric element 200 was charged is discharged during the transition from the first potential V1 to the second potential V2, which takes place from the time t1*e* to the time t2*s*. As a result of this, the piezoelectric element 200 is excited such that a meniscus is drawn in to the interior of the cavity 245. Thereafter, the second potential V2 is retained in the second period T2; from the time t2*e* to the time t3*s*, the transition is made from the second potential V2 to the third potential V3. In the period from the time t2*e* until the time t3*s*, the piezoelectric element 200 is charged with a charge. As a result of this, the piezoelectric element 200 is displaced in a direction that pushes the meniscus out to the exterior of the cavity 245. The third potential V3, however, is set such that ink is not discharged from the nozzle N. Were there to be a transition from the second potential V2 to the first potential V1, then the displacement of the piezoelectric element 200 would be returned to the original state in a short period of time, and ink would end up being discharged.

Therefore, in the present embodiment, the third potential V3 is set so as to be a potential that is between the first potential V1 and the second potential V2. Namely, in this example, the meniscus is drawn in as far as possible into the interior of the cavity 245 and, from this state, the meniscus is then returned such that ink is not discharged, and so doing generates a major pressure change in the interior of the cavity 245. This makes it possible to extract the residual vibration at a large amplitude. In other words, the drive unit is able to output a drive signal which becomes the first potential V1 during the first period, becomes the second potential V2 during the second period following the first period, and becomes the third potential V3, which is a potential between the first potential V1 and the second potential V2, during the third period following the second period. This makes it possible to generate a residual vibration of the magnitude needed for detection, without causing liquid to be discharged, by applying a major excitation force to the liquid in the process of the transition from the first potential V1 to the second potential V2 and thereafter changing from the second potential V2 to the third potential V3 and retaining the third potential V3.

Herein, when the inkjet printer is continuously printing by forming the image on the recording paper P, the passage of time as this printing is being carried out is accompanied by changes over time that include a gradual increase in the viscosity of the ink (thickening thereof). As the thickening of the ink progresses, there is the possibility that the behavior of the meniscus with respect to a predetermined potential in the drive signal Vin could change, and that, for example, the ink could end up being discharged at the third potential V3, which had been set as the non-discharge potential. For this reason, in the discharge malfunction detection process of the present invention, the third potential V3 is adjusted in accordance with states such as the viscosity of the ink. In other words, the third potential V3 is rendered modifiable in accordance with states such as the viscosity of the ink. This operation is carried out by the control unit 6. Namely, the control unit 6 is able to modify the third potential V3 within the range between the first potential V1 and the second potential V2. This makes it possible to have the potential of the third potential V3 be a potential corresponding to the state of the liquid, because the third potential V3 can be modified.

Figure 20:
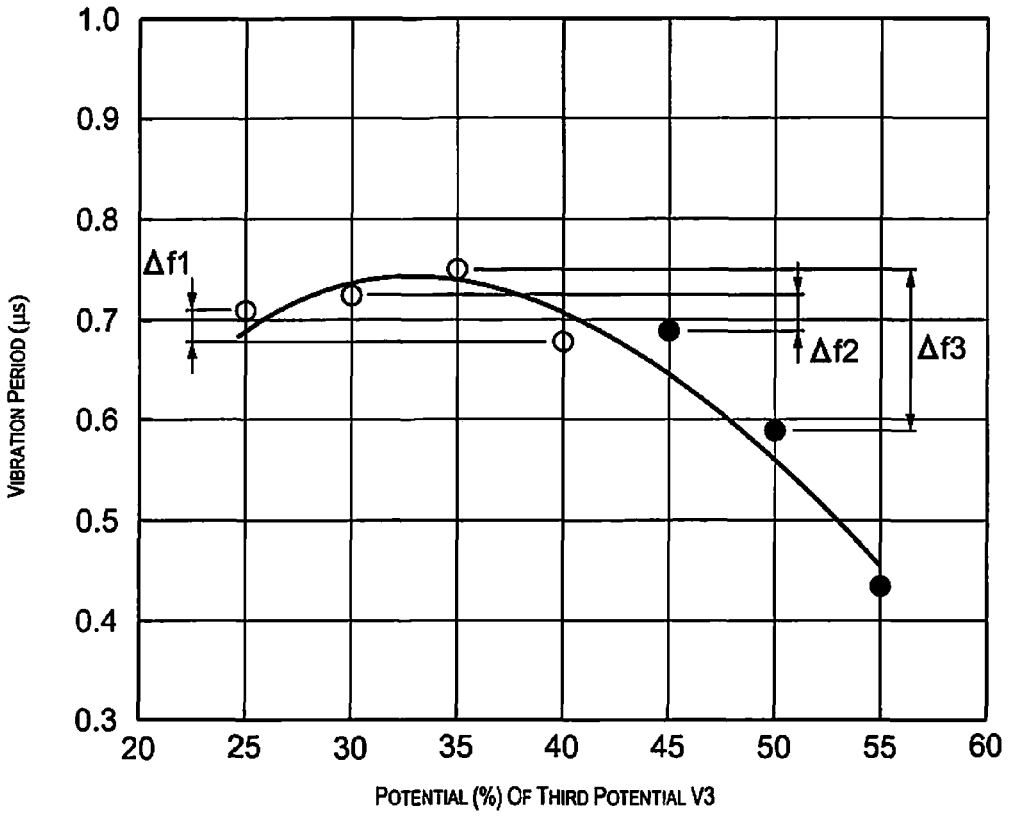
FIG. 20 is a descriptive view illustrating one working example of a method of adjusting a third potential V3 in an inspection drive signal.

A method of adjusting the third potential V3 shall be described in a specific manner below. FIG. 20 is a descriptive view illustrating one working example of a method of adjusting the third potential V3 in the inspection drive signal. The vertical axis is the vibration frequency (μs) of the cavity 245 interior, and the horizontal axis is the potential (%) of the third potential V3. Herein, the potential (%) of the third potential V3 is a percentage that represents the magnitude of the potential where the maximum potential is taken as 100%, within the range where the third potential V3 can be adjusted.

The method of adjusting the third potential V3 in the present embodiment comprises: comparing the inertance of the nozzle N at a first potential of the third potential V3 and the inertance of the nozzle N at a second potential of the third potential V3 that is higher by a predetermined amount than the first potential, while also gradually raising the first potential; and, when the difference between the inertance of the nozzle N at the first potential and the inertance of the nozzle N at the second potential has reached a threshold value or higher, then recognizing the second potential of V3 as being a potential for a discharge potential, and having a non-discharge potential of a potential that is lower by a predetermined amount than the potential of this discharge potential be the third potential V3. Herein, the inertance of the nozzle N is sensed by the vibration frequency (μs) of the cavity 245 interior, which is based on the changes in inertance of the nozzle N. In other words, the control unit 6 is able to modify the potential of the third potential V3 based on changes in the inertance of the nozzle N. This makes it possible to have the potential of the third potential V3 be a potential corresponding to the inertance, which changes depending on the state of the liquid. In a more detailed description, the control unit 6 is able to modify the potential of the third potential V3 based on the vibration frequency of the pressure chamber, which changes in association with changes in the inertance. This makes it possible to have the potential of the third potential V3 be a potential corresponding to the vibration frequency of the pressure chamber, which changes depending on the inertance.

In FIG. 20, the second potential of V3 is put at a potential 15% higher than the first potential, and the first potential starts from 25%. That is to say, the start originates from a comparison between the vibration frequency of the cavity 245 interior at 25%, serving as the first potential of V3, and the vibration frequency of the cavity 245 interior at 40%, serving as the second potential. In the present embodiment, the aforementioned threshold value is put at 0.15 (μs).

In FIG. 20, firstly, the vibration frequency at the first potential 25% of V3 is 0.71 μs, and the vibration frequency at the second potential 40% with respect thereto. Herein, a difference Δf1 between the vibration frequencies is 0.04, which is lower than the threshold value.

Next, the vibration frequency at a potential 30%, where the first potential of V3 has been raised 5%, is 0.72 μs, and the vibration frequency at the second potential 45% with respect thereto is 0.69 μs. Herein, a difference Δf2 between the vibration frequencies is 0.03, which is lower than the threshold value.

Next, the vibration frequency at a potential 35%, where the potential of V3 has been raised 5%, is 0.74 μs, and the vibration frequency at the second potential 50% with respect thereto is 0.59 μs. Here, the difference Δf3 between the vibration frequencies reaches 0.15, which is exactly the threshold value, and the potential 50% of V3 can be determined to be the discharge potential.

According to this method of comparing the inertance (the vibration frequency of the cavity 245 interior; the same applies hereinbelow) of the nozzle N at the first potential of V3 and the inertance of the nozzle N at the second potential higher by a predetermined amount than the first potential, while also gradually raising the first potential, and recognizing, as the potential of the discharge potential, the second potential of V3 when the difference between the inertance of the nozzle N at the first potential and the inertance of the nozzle N at the second potential has reached the threshold value or higher, the amount of change in the inertance of the nozzle N can be allowed to be greater than a case where one arbitrary potential is gradually raised meanwhile the inertance of the nozzle N at each of the potentials is being checked; therefore, a discharge potential close to the boundary between the discharge potential and the non-discharge potential can be more clearly sensed.

It is then possible to derive the third potential V3 of a potential that is lower by a predetermined magnitude based on a data table possessed by the control unit 6, from the potential 50% of V3 having been sensed as the discharge potential in the current state of the ink.

Incorporating the third potential V3 derived in this manner into the waveform of the inspection drive signal Vin[M] illustrated in FIG. 19 makes it possible to prevent the ink from being discharged in the state of ink at this time, and possible to enact a state where the meniscus has been returned as much as possible to the nozzle surface side of the nozzle N; therefore, it becomes possible to generate a considerable pressure change in the interior of the cavity 245, and possible to extract the residual vibration at a considerable amplitude. In other words, the control unit 6 is able to modify the potential of the third potential V3 based on the difference between the vibration frequency of the pressure chamber at the discharge potential, which is the potential at which the liquid is discharged from the nozzle N, and the vibration frequency of the pressure chamber at the non-discharge potential, which is a potential at which the liquid is not discharged from the nozzle N. This makes it possible to have the third potential V3 be a non-discharge potential with higher accuracy, and makes it possible to generate a residual vibration of the magnitude needed for detection without causing the liquid to be discharged.

Returning now to FIG. 19, the description continues by addressing the inspection drive signal Vin[M]. In the present embodiment, preferably, a period TXa is defined as follows, where TXa is the period from the end time t1*e* of the first period T1 to the end time t2*e* of the second period T2, and Tc is the natural vibration frequency of the cavity 245.

Deflection of the piezoelectric element 200 causes the ink inside the cavity 245 to be vibrated. At this time, the pressure inside the cavity 245 increases and decreases in synchronization with the natural vibration frequency Tc. The end time t2*e* of the second period T2, in turn, is a timing at which the direction of the displacement of the piezoelectric element 200 is changed. In order to obtain a large residual vibration, it is preferably to change the direction of the displacement of the piezoelectric element 200 in synchronization with the changes in pressure inside the cavity 245. In such a case, the pressure inside the cavity shifts from decreasing to increasing at a timing where the period TXa is equal to Tc/2 in FIG. 21. As such, the period TXa is preferably equal to Tc2.

Figure 21:
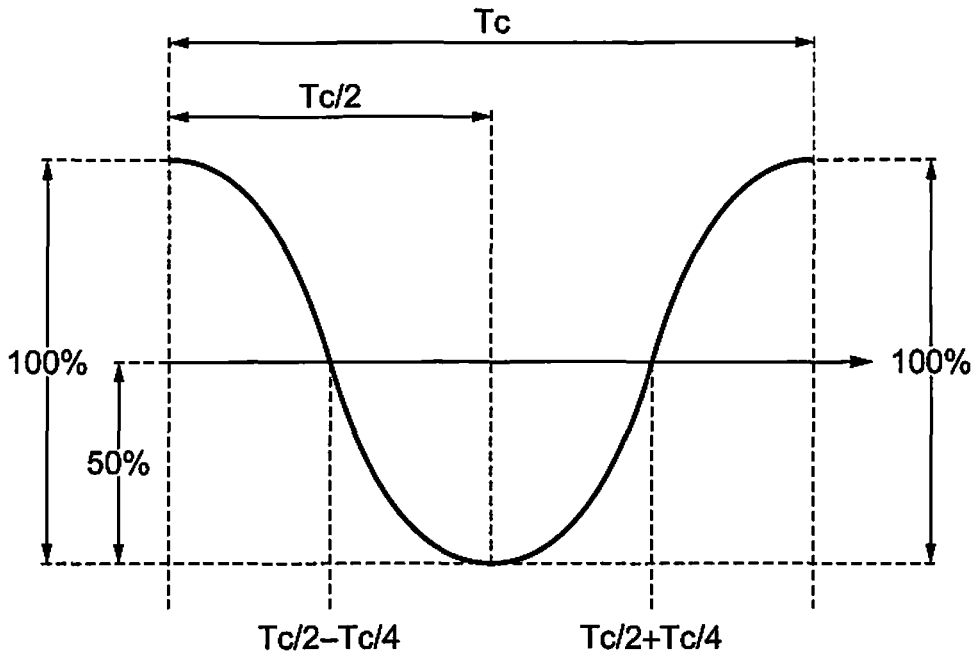
FIG. 21 is a descriptive view illustrating a pressure change of a cavity.

In FIG. 21, the range from [Tc/2−Tc/4] to [Tc/2+Tc/4] is a range of 50% of the maximum amplitude. As such, setting the period TXa so as to fulfill the following formula (1) makes it possible to increase efficiency as compared to a case where the period TXa is in the range from [0] to [Tc/2−Tc/4] or in the range from [Tc/2+Tc/4] to [Tc].

$$Tc/2-Tc/4<TXa<Tc/2+Tc/4 \quad (1)$$

Also, in particular the range from Tc/2 to Tc/2+Tc/4 is after the pressure has shifted from decreasing to increase, and therefore setting the period TXa in this range makes it possible to further increase efficiency.

The third period T3 (see FIG. 19, etc.) is when the residual vibration is detected in the discharge malfunction detection unit 52. In other words, a detection unit 55 detects the residual vibration when the drive signal is in the third period. This makes it possible to detect, at higher accuracy, a residual vibration of the magnitude needed for detection, which is generated without causing the liquid to be discharged. The third period T3 is longer than the second period T2, so that the residual vibration can be fully detected at this time. Also, in the analysis of the residual vibration, actually sensing the natural vibration frequency Tc of the cavity 245 is important for identifying the state of discharge of the ink. As such, the third period T3 is set so as to be longer than the natural vibration frequency Tc.

Moreover, though the residual vibration has been actively put to use in the inspection of the state of discharge of the ink, the discharge of the ink may in some instances be adversely affected when, during normal printing, the residual vibration that was generated in the previous unit operation period Tu has an impact. Therefore, it is preferable to define the length of the third period T3 so as to cancel out the residual vibration. More specifically, it suffices for the third period T3 to be set to a natural number multiple of the natural vibration frequency Tc. As is the case with the setting of the period TXa described above, setting the third period T3 so as to satisfy the formula (2) makes it possible to effectively cancel out the residual vibration.

$$k\cdot Tc-Tc/4<T3<k\cdot Tc+Tc/4 \quad (2),$$

where k is a natural number.

The inkjet printer 1 as in the present embodiment uses the inspection drive signal Vin, and detects, as the residual vibration signal Vout, the change in the electromotive force of the piezoelectric element 200 that is based on the pressure change of the cavity 245 interior of the relevant discharge unit 35 produced as a consequence thereof. The discharge malfunction detection process is then executed, in which a determination is made as to whether or not the relevant discharge unit 35 is experiencing a discharge malfunction, based on the residual vibration signal Vout.

Figure 22:
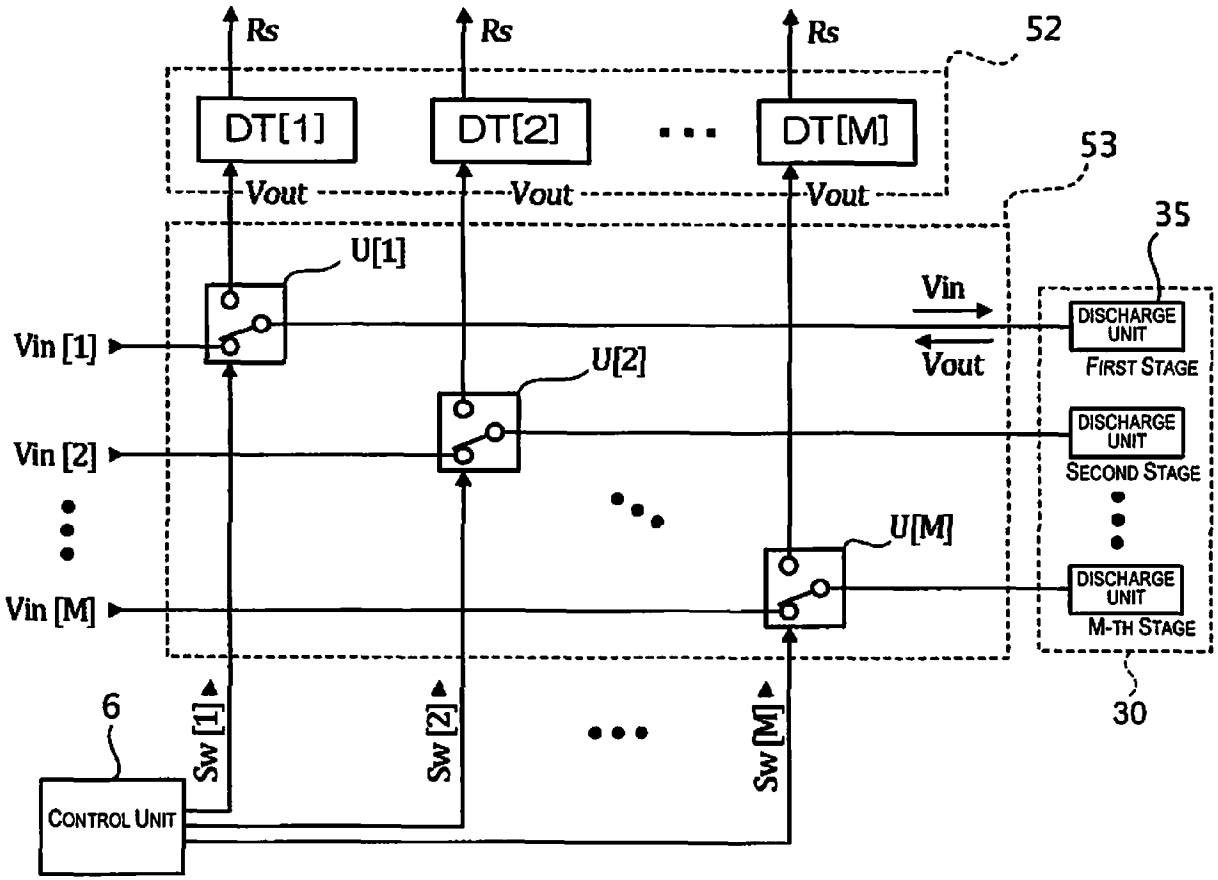
FIG. 22 is a block diagram illustrating the configuration of a switching unit.

FIG. 22 is a block diagram illustrating the configuration of the switching unit 53 serving as a part of the head driver 50, and also illustrating the electrical connection relationships among the switching unit 53, the discharge malfunction detection unit 52, the head unit 30, and the drive signal generation unit 51.

As illustrated in FIG. 22, the switching unit 53 is provided with a number M of switching circuits U (U[1], U[2], . . . , U[M]) of a first stage through M-th stage, which have a one-to-one correspondence with the number M of discharge units 35. A switching unit U[m] of the m-th stage electrically connects the discharge unit 35 of the m-th stage to either a wiring from which the drive signal Vin[M] is supplied, or to the discharge malfunction circuit DT, which is provided to the discharge malfunction detection unit 52.

Below, the name "first connection state" shall be used to refer to a state where the discharge units 35 and the drive signal generation unit 51 are electrically connected at each of the switching circuits U. The name "second connection state" shall be used to refer to a state where the discharge units 35 and the discharge malfunction detection circuits DT of the discharge malfunction detection unit 52 are electrically connected.

The control unit 6 supplies the switching control signal Sw[m] for controlling the connection state of the switching circuit U[m] to the switching circuit U[m] of the m-th stage.

More specifically, the control unit 6 outputs the switching control signals Sw[1], Sw[2], . . . , Sw[M] so that during the unit operation period Tu, the switching circuits corresponding to the discharge units 35 that are executing printing are placed in the first connection state, and the switching circuits corresponding to the discharge units 35 intended to be inspected are placed in the second connection state. Namely, in the unit operation period Tu, either switching control signals Sw that designate the first connection state and the second connection state are mixed together, or the switching control signals Sw may all designate the first connection state, or the switching control signals Sw may all designate the second connection state.

Figure 23:
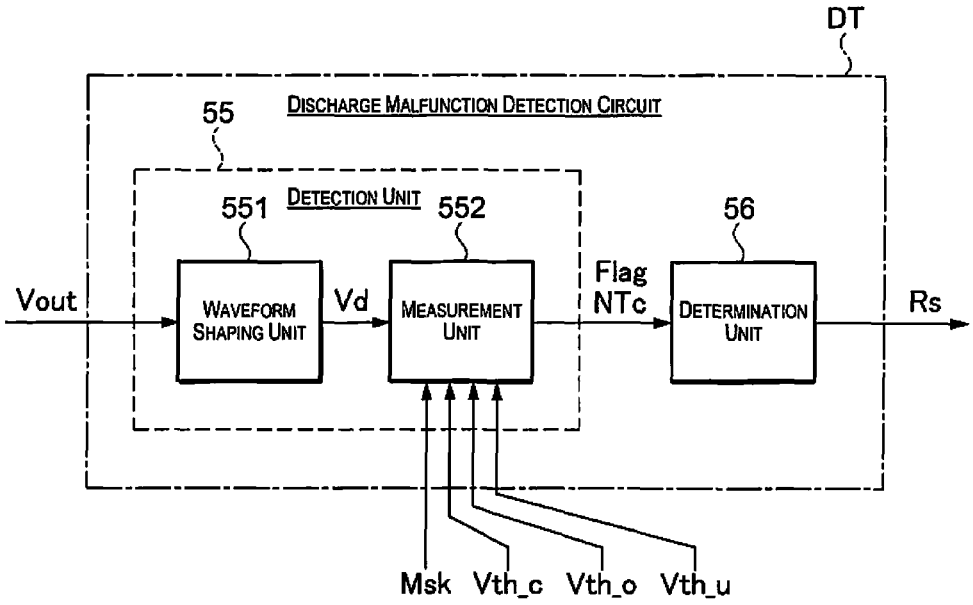
FIG. 23 is a block diagram illustrating the configuration of a discharge malfunction detection circuit.

FIG. 23 is a block diagram illustrating the configuration of a discharge malfunction detection circuit DT provided to the discharge malfunction detection unit 52, forming a part of the head driver 50.

As illustrated in FIG. 23, the discharge malfunction detection circuit DT is equipped with: the detection unit 55, which outputs a detection signal NTc representative of the length of time amounting to one period of the residual vibration of the discharge unit 35; and a determination unit 56 for determining whether or not there is a discharge malfunction in the discharge unit 35 as well as the state of discharge thereof in the event that there is a discharge malfunction, based on the detection signal NTc, and outputting the determination result signal Rs representative of the determination result.

The detection unit 55 forming a part thereof is provided with a waveform shaping unit 551 for generating a shaped waveform signal Vd obtained by removing a noise component and the like from the residual vibration signal Vout outputted from the discharge unit 35, and a measurement unit 552 for generating the detection signal NTc based on the shaped waveform signal Vd.

The waveform shaping unit 551 is provided with, for example, a high-pass filter for outputting a signal with which a lower-range frequency component than the frequency band of the residual vibration signal Vout has been attenuated, a low-pass filter for outputting a signal with which a higher-range frequency component than the frequency band of the residual vibration signal Vout has been attenuated, and the like, and comprises a configuration capable of outputting the shaped waveform signal Vd with which the frequency range of the residual vibration signal Vout has been limited and a noise component has been removed.

The waveform shaping unit 551 may also be a configuration comprising a negative feedback amplifier for adjusting the amplitude of the residual vibration signal Vout, a voltage follower for converting the impedance of the residual vibration signal Vout and outputting a low-impedance shaped waveform signal Vd, and the like.

Supplied to the measurement unit 552 are: the shaped waveform signal Vd obtained when the residual vibration signal Vout is shaped at the waveform shaping unit 551; a mask signal Msk generated by the control unit 6; a threshold value potential Vth_c defined by the potential of the amplitude center level of the shaped waveform signal Vd; a threshold value potential Vth_o defined by a higher potential than the threshold value potential Vth_c; and a threshold value potential Vth_u defined by a lower potential than the threshold value potential Vth_c. The measurement unit 552 outputs the detection signal NTc and a validity flag indicative of whether or not the relevant detection NTc is a valid value, based on these signals and the like.

Figure 24:
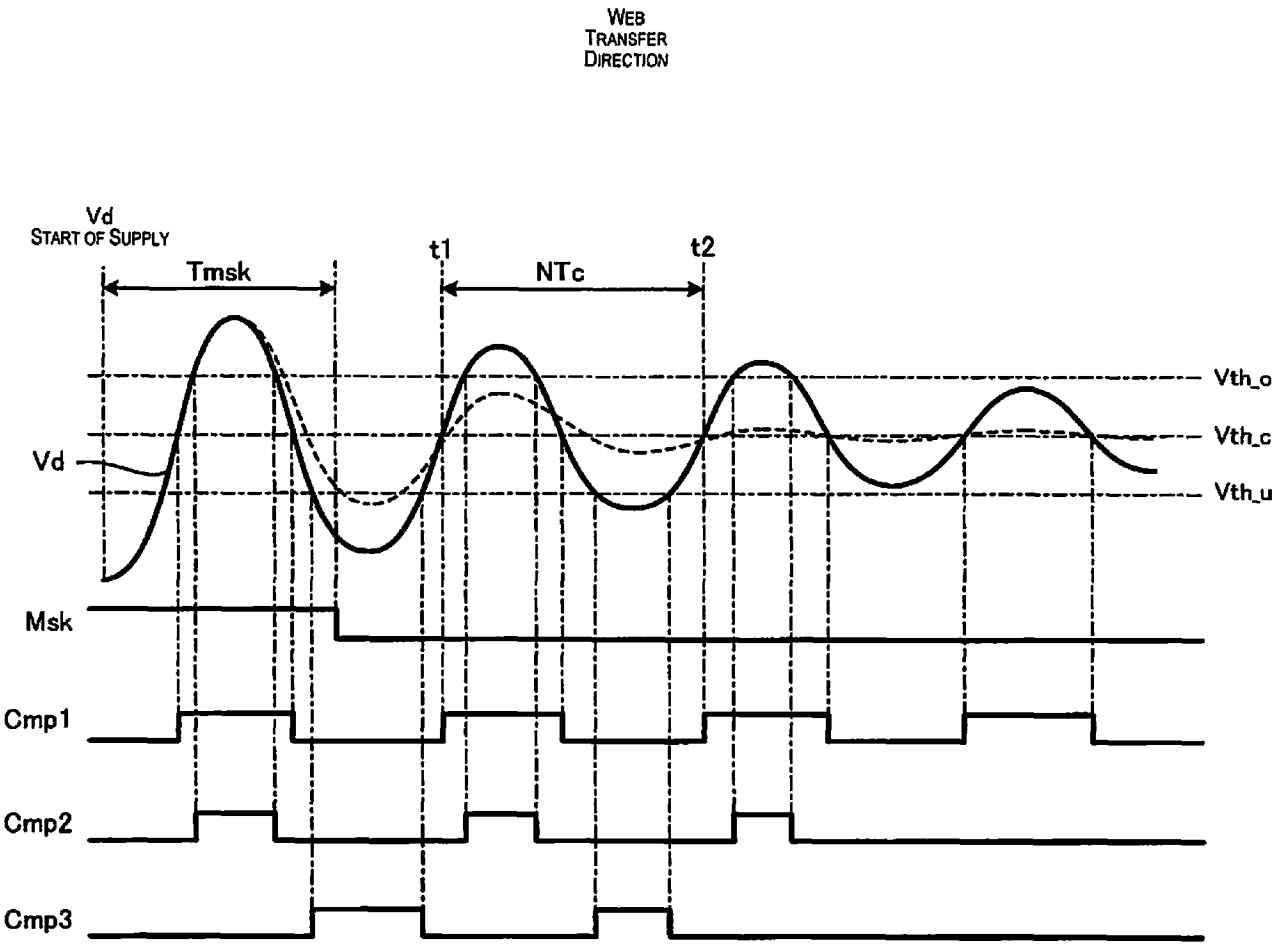
FIG. 24 is a timing charge illustrating the operation of a discharge malfunction detection circuit.

FIG. 24 is a timing chart illustrating the operation of the measurement unit 552.

As illustrated in FIG. 24, the measurement unit 552 compares the potential indicated by the shaped waveform signal Vd and the threshold value potential Vth_c, and generates a comparison signal Cmp1 which will be a high level in a case where the potential indicated by the shaped waveform signal Vd is not less than the threshold value potential Vth_c, and will be a low level in a case where the potential indicated by the shaped waveform signal Vd is less than the threshold value potential Vth_c.

The measurement unit 552 also compares the potential indicated by the shaped waveform signal Vd and the threshold value potential Vth_o, and generates a comparison signal Cmp2 which will be a high level in a case where the potential indicated by the shaped waveform signal Vd is not less than the threshold value potential Vth_o, and will be a low level in a case where the potential indicated by the shaped waveform signal Vd is less than the threshold value potential Vth_o.

The measurement unit 552 furthermore compares the potential indicated by the shaped waveform signal Vd and the threshold value potential Vth_u, and generates a comparison signal Cmp3 which will be a high level in a case where the potential indicated by the shaped waveform signal Vd is less than the threshold value potential Vth_u, and will be a low level in a case where the potential indicated by the shaped waveform signal Vd is not less than the threshold value potential Vth_u.

The mask signal Msk is a signal that will be a high level only as long as a predetermined period Tmsk after the supply of the shaped waveform signal Vd from the waveform shaping unit 551 has been started. In the present embodiment, generating the detection signal NTc by targeting solely the shaped waveform signal Vd after the period Tmsk has elapsed, out of the shaped waveform signal Vd as a whole, makes it possible to obtain a high-precision detection signal NTc from which a noise component that is superimposed immediately after the start of residual vibration has been removed.

The measurement unit 552 is provided with a counter (not shown). This counter starts counting a clock signal (not shown) at a time t1, which is a time at which the potential indicated by the shaped waveform signal Vd first becomes equal to the threshold value potential Vth_c after the mask signal Msk has fallen to the low level. Namely, the counter starts counting at the time t1, which is the earlier timing of either the timing at which the comparison signal Cmp1 first rises to the high level or the timing at which the comparison signal Cmp1 first falls to the low level, after the mask signal Msk has fallen to the low level.

After having started counting, the counter concludes counting the clock signal at a time t2, which is a timing at which the potential indicated by the shaped waveform signal Vd becomes the threshold value potential Vth_c for the second time, and outputs the resulting count value as the detection signal NTc. Namely, the counter starts counting at the time t2, which is the earlier timing of either the timing at which the comparison signal Cmp1 rises to the high level for the second time or the timing at which the comparison signal Cmp1 falls to the low level for the second time, after the mask signal Msk has fallen to the low level.

In this manner, the measurement unit 552 generates the detection signal NTc by measuring the length of time from the time t1 until the time t2, as the length of time amounting to one period of the shaped waveform signal Vd.

However, in a case where the shaped waveform signal Vd has a small amplitude, as illustrated with the single-dot dashed line in FIG. 24, then there is a greater possibility that the detection signal NTc cannot be accurately measured. Moreover, in a case where the shaped waveform signal Vd has a small amplitude, there exists the possibility that, were the state of discharge of the discharge unit 35 to have been determined to be normal on the basis solely of the result of the detection signal NTc, a discharge malfunction still could have actually taken place. Conceivable examples include when, in a case where the shaped waveform signal Vd has a small amplitude, the ink has not been injected into the cavity 245 and this makes it possible to discharge the ink.

Therefore, in the present embodiment, a determination is made as to whether or not the shaped waveform signal Vd has a large enough amplitude to measure the detection signal NTc, and the result of this determination is outputted as the validity flag FLag.

More specifically, the measurement unit 552 sets the value of the validity flag FLag to a value "1" indicated that the detection signal NTc is valid in a case where the potential indicated by the shaped waveform signal Vd exceeds the threshold value potential Vth_o and is lower than the threshold signal Vth_u during the period where the counting is being executed by the counter, i.e., during the period from the time t1 until the time t2; in other cases, the value of the validity flag FLag is set to "0", whereupon the validity flag FLag is then outputted. In a more detailed description, the measurement unit 552 sets the value of the validity flag FLag to "1" in a case where the comparison signal Cmp2 has risen from the low level to the high level and thereafter again fallen to the low level and the comparison signal Cmp3 has risen from the low level to the high level and thereafter again fallen to the low level during the period from the time t1 to the time t2; in other cases, the value of the validity flag FLag is set to "0".

In this manner, in the present embodiment, in addition to generating the detection signal NTc indicative of the length of time amounting to one period of the shaped waveform signal Vd, the measurement unit 552 also determines whether or not the shaped waveform signal Vd has a large enough amplitude to measure the detection signal NTc, and therefore the discharge malfunction can be detected more accurately. As a summary regarding the detection unit 55, the detection unit 55 detects the residual vibration within the pressure chamber that is generated by the drive signal.

The determination unit 56 determines the state of discharge of the ink in the discharge unit 35 based on the detection signal NTc and the validity flag FLag, and outputs the determination result as the determination result signal Rs.

FIG. 25 is a descriptive view for describing the content of the determination in the determination unit 56. As illustrated in FIG. 25, the determination unit compares the length of time indicated by the detection signal NTc respectively against a threshold value NTX1, a threshold value NTX2 representative of a length of time longer than the threshold value NTX1, and a threshold value NTX3 representative of a length of time even longer than the threshold value NTX2.

Here, the threshold value NTX1 is a value for indicating a boundary between the length of time amounting to one period of the residual vibration in a case where air bubbling has occurred in the cavity 245 interior and the frequency of the residual vibration has risen, and the length of time amounting to one period of the residual vibration in a case where the state of discharge is normal.

The threshold value NTX2 is a value for indicating a boundary between the length of time amounting to one period of the residual vibration in a case where paper dust has adhered to the vicinity of the exit of the nozzle N and the frequency of the residual vibration has fallen, and the length of time amounting to one period of the residual vibration in a case where the state of discharge is normal.

The threshold value NTX3 is a value for indicating a boundary between the length of time amounting to one period of the residual vibration in a case where the frequency of the residual vibration has become even lower than a case where paper dust has adhered, due to sticking fast or thickening of the ink in the vicinity of the nozzle N, and the length of time amounting to one period of the residual vibration in a case where paper dust has adhered to the vicinity of the exit of the nozzle N.

As illustrated in FIG. 25, in a case where the value of the validity flag FLag is "1" and the relationship "NTX1≤NTc≤NTX2" is satisfied, the determination unit 56 determines that the state of discharge of the ink in the discharge unit 35 is normal and sets a value "1", indicating that the state of discharge is normal, for the determination result signal Rs.

In a case where the value of the validity flag FLag is "1" and the relationship "NTc<NTX1" is satisfied, the determination unit 56 determines that a discharge malfunction is occurring due to air bubbling produced in the cavity 245, and sets a value "2", indicating that a discharge malfunction caused by air bubbling is taking place, for the determination result signal Rs.

In a case where the value of the validity flag FLag is "1" and the relationship "NTX2<NTc≤NTX3" is satisfied, the determination unit 56 determines that a discharge malfunction is occurring due to paper dust that has adhered to the vicinity of the exit of the nozzle N, and sets a value "3", indicating that a discharge malfunction caused by paper dust is taking place, for the determination result signal Rs.

In a case where the value of the validity flag FLag is "1" and the relationship "NTX3<NTc" is satisfied, the determination unit 56 determines that a discharge malfunction is occurring due to thickening of the ink in the vicinity of the nozzle N, and sets a value "4", indicating that a discharge malfunction caused by ink thickening is taking place, for the determination result signal Rs.

As described above, in the determination unit 56, a determination is made as to whether or not a discharge malfunction is taking place in the discharge unit 35, and the determination result is outputted as the determination result signal Rs. For this reason, in a case where a discharge malfunction is occurring, the control unit 6 is able to, where necessary, interrupt the printing process (more strictly speaking, interrupt the printing operation period) and move the head unit 30 to the initial position (X=Xini), and is thereupon able to execute the appropriate restoration process corresponding to the cause of discharge malfunction indicated in the determination result signal Rs.

The determination in the determination unit 56 may also be executed in the control unit 6 (the CPU 61). In such a case, the discharge malfunction detection circuits DT of the discharge malfunction detection unit 52 would be configured so as not to be provided with the determination unit 56, and it would suffice for the detection signal NTc generated by the detection units 55 to be outputted to the control unit 6.

In this manner, according to the present embodiment, in the inspection drive signal Vin, the level thereof is transitioned from the first potential V1 to the second potential V2, and furthermore is changed from the second potential V2 to the third potential V3, which is a potential between the first potential V1 and the second potential V2. This makes it possible to impart a large excitation force to the ink while in the process of transitioning from the first potential V1 to the second potential V2; furthermore, changing from the second potential V2 to the third potential V3 and retaining the third potential V3 makes it possible to control the internal pressure of the cavity 245 such that the ink is not discharged from the nozzle N, while the excitation force is also being put to use.

Also, prior to the discharge malfunction detection, the present embodiment further comprises a method for detecting the output of the discharge potential at the vicinity of the boundary between the non-discharge potential and the discharge potential in states such as thickening of the ink at that time, and deciding on the third potential that is the non-discharge voltage in the inspection drive signal Vin based on the output of the discharge potential. This makes it possible to address temporal changes such as thickening of the ink, and accurately detect and determine the state of discharge of the ink by obtaining a large residual vibration without causing the ink to be discharged from the nozzle N.

The foregoing specifically describes an embodiment of the present invention as made by the present inventors, but the present invention is in no way limited to the embodiment and modification examples stated above, and a variety of modifications could be added within a scope that does not depart from the essence thereof.

For example, in the embodiment described above, the inspection drive signal Vin had three states—the first potential V1, the second potential V2, and the third potential V3, but the present invention is in no way limited thereto, and the inspection drive signal Vin may be a drive signal of a waveform that comprises four or more potentials.

In the embodiment described above, the inkjet printer as a line printer, such as illustrated in FIG. 2, but the inkjet printer may also be a serial printer. For example, instead of the head unit 30 illustrated in FIG. 2, the inkjet printer may be provided with a head unit where the width in the Y-axis direction is narrower than the width of the recording paper P, the main scanning direction of the carriage then being the Y-axis direction.

In the embodiment described above, an inkjet printer was illustratively exemplified as one example of a liquid discharge apparatus for discharging ink as a liquid, but the present invention is in no way limited thereto, and may be any apparatus whatsoever, provided that a liquid is discharged. For example, the apparatus may be one that discharges liquids (including dispersions such as suspensions and emulsions) including the following variety of materials. Namely, possible examples include: a filter material (ink) for a color filter; a light-emitting material for forming an electroluminescence (EL) light-emitting layer in an organic EL apparatus; a fluorescent material for forming a phosphor on an electrode in an electron emission apparatus; a fluorescent material for forming a phosphor in a plasma display (PDP) apparatus; an electrophoretic material for forming an electrophoresis body in an electrophoretic display apparatus; a bank material for forming a bank on the surface of a substrate W; a variety of coating materials; a liquid electrode material for forming an electrode; a particulate material for forming a spacer for constituting a minute cell gap between two substrates; a liquid metal material for forming a metal wiring; a lens material for forming a microlens; a resist material; an optical diffusion material for forming an optical diffuser; a variety of experimental liquid materials that are used for biosensors, such as DNA chips and protein chips; and the like.

Moreover, in the present invention, the recording medium serving as the target for discharging the liquid is not limited to being paper like the recording paper P, but rather may be another medium such as a woven fabric or non-woven fabric, or a workpiece such as a glass substrate, a silicon substrate, or a variety of other substrates.

In the inkjet printer 1 described in the embodiment above, not all of the inspections of the state of discharge need be the discharge malfunction detection process (non-discharge inspection) using the inspection drive signal Vin that includes the non-discharge third potential V3. Preferably, the non-discharge inspection is carried out at least during the printing of an image onto the recording paper P. So doing makes it possible to inspect without fouling the recording paper P receiving the printing. At times other than printing of an image onto the recording paper P (before the start of printing or after the end of printing), the liquid may also be discharged during the inspection of the state of discharge (a discharge inspection). In a case where there is concern that, for example, foreign matter such as paper dust could adhere to the nozzles N during printing, there may be a foreign matter inspection for detecting foreign matter. The foreign matter inspection may be, for example, the act of inspecting after air bubbles have been introduced by breaking the meniscus, on a nozzle N to which foreign matter has attached. In this manner, a plurality of types of inspections may be judiciously used selectively in accordance with the circumstances of the inkjet printer 1. For example, the control unit 6 may execute the non-discharge inspection where the liquid is not discharged when an image is being printed, and execute the discharge inspection where the liquid is indeed discharged when an image is not being printed. Carrying out the optimal inspection in accordance with the circumstances makes it possible to carry out each of the inspections appropriately.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A liquid discharge apparatus comprising:

a head having a piezoelectric element configured and arranged to vibrate a diaphragm, a pressure chamber where an interior pressure is increased or decreased by vibration of the diaphragm, and a nozzle communicating with the pressure chamber and configured and arranged to discharge a liquid inside the pressure chamber according to increasing and decreasing of the interior pressure of the pressure chamber;

a drive unit configured and arranged to output a drive signal to the piezoelectric element such that the drive signal becomes a first potential during a first period, becomes a second potential during a second period following the first period, and becomes a third potential, which is a potential between the first potential and the second potential, during a third period following the second period;

a detection unit configured and arranged to detect a residual vibration inside the pressure chamber that is produced by the drive signal; and a control unit configured to modify the potential of the third potential of the drive signal within a range between the first potential and the second potential.

2. The liquid discharge apparatus as set forth in claim 1, wherein the control unit is configured to modify the potential of the third potential of the drive single based on a change in inertance of the nozzle.

3. The liquid discharge apparatus as set forth in claim 2, wherein the control unit is configured to modify the potential of the third potential of the drive signal based on a vibration frequency of the pressure chamber, which changes in association with the change in inertance.

4. The liquid discharge apparatus as set forth in claim 3, wherein the control unit is configured to modify the potential of the third potential of the drive signal based on a difference between:

a vibration frequency of the pressure chamber at a discharge potential, which is a potential at which the liquid is discharged from the nozzle; and a vibration frequency of the pressure chamber at a non-discharge potential, which is a potential at which the liquid is not discharged from the nozzle.

5. The liquid discharge apparatus as set forth in claim 1, wherein the detection unit is configured and arranged to detect the residual vibration when the drive signal is in the third period.

* * * * *